US008221197B2

(12) United States Patent
Boeck et al.

(10) Patent No.: US 8,221,197 B2
(45) Date of Patent: Jul. 17, 2012

(54) HAND-HELD POWER TOOL SYSTEM

(75) Inventors: Cornelius Boeck, Kirchheim (DE); Joachim Schadow, Leinfelden-Echterdingen (DE); Sinisa Andrasic, Schoenaich (DE)

(73) Assignee: Robert Bosch GmbH, Stuttgart (DE)

( * ) Notice: Subject to any disclaimer, the term of this patent is extended or adjusted under 35 U.S.C. 154(b) by 594 days.

(21) Appl. No.: 12/293,850

(22) PCT Filed: Nov. 9, 2007

(86) PCT No.: PCT/EP2007/062136

§ 371 (c)(1),
(2), (4) Date: Sep. 22, 2008

(87) PCT Pub. No.: WO2008/058910

PCT Pub. Date: May 22, 2008

(65) Prior Publication Data

US 2009/0130961 A1 May 21, 2009

(30) Foreign Application Priority Data

Nov. 13, 2006 (DE) ..... 10 2006 053 305

(51) Int. Cl.
*B24B 23/00* (2006.01)

(52) U.S. Cl. ..... 451/344; 451/451; 451/452; 451/456; 451/457

(58) Field of Classification Search ..... 451/344, 451/357, 359, 451, 452, 456, 457, 459
See application file for complete search history.

(56) References Cited

U.S. PATENT DOCUMENTS

| | | | | |
|---|---|---|---|---|
| 2,819,570 | A | 1/1958 | Tocci-Guilbert et al. | |
| 2,922,261 | A * | 1/1960 | Rabkin et al. | 451/359 |
| 3,068,620 | A * | 12/1962 | Tocci-Guilbert | 451/451 |
| 3,793,784 | A * | 2/1974 | Jetzt | 451/452 |
| 4,924,635 | A * | 5/1990 | Rudolf et al. | 451/344 |
| 5,384,985 | A | 1/1995 | Jacobsson | |
| 5,545,082 | A * | 8/1996 | Courson et al. | 451/456 |
| 5,766,062 | A | 6/1998 | Edling | |
| 6,464,573 | B1 * | 10/2002 | Keller | 451/451 |
| 6,669,544 | B1 * | 12/2003 | Walz et al. | 451/454 |
| 6,893,334 | B1 * | 5/2005 | Stivers | 451/359 |
| 6,949,017 | B2 * | 9/2005 | Koschel et al. | 451/358 |
| 6,988,939 | B2 * | 1/2006 | Hofmann et al. | 451/344 |
| 7,014,547 | B2 * | 3/2006 | Kleider | 451/359 |
| 7,063,606 | B2 * | 6/2006 | Stierle et al. | 451/359 |

(Continued)

FOREIGN PATENT DOCUMENTS

DE 101 15 635 9/1957

(Continued)

*Primary Examiner* — George Nguyen
(74) *Attorney, Agent, or Firm* — Michael J. Striker

(57) ABSTRACT

The invention relates to a portable power tool system comprising a portable power tool (12*a-n*), especially an angle grinder, a protective hood unit (14*a-n*) and a protective hood anti-rotation lock (16*a-n*) for providing anti-rotational locking between the protective hood unit (14*a-n*) and the portable power tool (12*a-n*) in the event of a breakage of a tool (18*a-n*). According to the invention, the protective hood anti-rotation lock (16*a-n*) is adapted to provide anti-rotational locking between the protective hood unit (14*a-n*) and the portable power tool (12*a-n*) while at the same time securing the protective hood unit (14*a-n*) to the portable power tool (12*a-n*) in a working position of the protective hood unit (14*a-n*).

1 Claim, 14 Drawing Sheets

U.S. PATENT DOCUMENTS

| | | | | |
|---|---|---|---|---|
| D537,692 | S * | 3/2007 | Aglassinger | D8/70 |
| 7,311,589 | B2 * | 12/2007 | Wiker | 451/451 |
| 7,524,239 | B2 * | 4/2009 | Schmidberger-Brinek et al. | 451/451 |
| 7,628,682 | B2 * | 12/2009 | Andrasic et al. | 451/451 |
| 7,892,075 | B2 * | 2/2011 | Esenwein | 451/451 |
| 7,909,680 | B2 * | 3/2011 | Boeck et al. | 451/344 |
| 7,927,191 | B2 * | 4/2011 | Esenwein | 451/451 |
| 7,955,162 | B2 * | 6/2011 | Boeck et al. | 451/451 |
| 2006/0052041 | A1 | 3/2006 | Wiker | |
| 2006/0068690 | A1 * | 3/2006 | Koschel et al. | 451/451 |
| 2009/0098812 | A1 | 4/2009 | Boeck et al. | |
| 2009/0130961 | A1 | 5/2009 | Boeck et al. | |

FOREIGN PATENT DOCUMENTS

| | | | |
|---|---|---|---|
| DE | 3940584 | A1 * | 6/1991 |
| EP | 0 812 657 | | 12/1997 |
| EP | 1 618 990 | | 1/2006 |
| RU | 2 032 520 | | 4/1995 |
| SU | 495192 | | 12/1975 |
| WO | 02/070201 | | 9/2002 |
| WO | 2004/087377 | | 10/2004 |

* cited by examiner

HAND-HELD POWER TOOL SYSTEM

CROSS-REFERENCE TO A RELATED APPLICATION

The invention described and claimed hereinbelow is also described in German Patent Application DE 10 2006 053.4 filed on Nov. 13, 2006. The German Patent Application, whose subject matter is incorporated here by reference, provides the basis for a claim of priority of invention under 35 U.S.C. 119 (a)-(d).

BACKGROUND OF THE INVENTION

The present invention relates to a hand-held power tool system.

Publication EP 812 657 A1 makes known an angle grinder with an adjustable guard. In that case, the guard is adjustable in a rotating manner on a connection piece of a flange of the angle grinder, and is supported such that it may be detachably attached using a single form-fit locking means. The spindle of the angle grinder passes through the center of the flange. A cutting disk and/or grinding disk are/is installed on the free end of the spindle in a clampable, rotationally drivable manner for cutting and machining work pieces, which are partially enclosed by the guard. The guard must be positioned in a rotationally adjustable manner on the hand-held power tool such that the region of the grinding disk that faces the user is enclosed by the guard. At the same time, a region of the grinding disk that points away from the user extends past the flange, radially relative to the work piece engagement.

SUMMARY OF THE INVENTION

The present invention is directed to a hand-held power tool system with a hand-held power tool, in particular an angle grinder, a guard unit, and a guard anti-rotation lock unit, which is provided to prevent rotation between the guard unit and the hand-held power tool during breakdown of a tool.

It is provided that the guard anti-rotation lock unit is provided to prevent rotation between the guard unit and the hand-held power tool at the same time as the guard unit is being attached to the hand-held power tool when the guard unit is in a working position. In this context, "provided" is intended to mean, in particular, specially equipped and/or designed. In addition, the expression "working position of the guard unit" refers, in particular, to a position of the guard unit in which the guard unit is non-rotatably located on the hand-held power tool during regular working operation of the hand-held power tool, and a guard of the guard unit ensures advantageous protection for an operator against contact with a tool, in particular a disk-shaped, rotatably drivable tool, and/or from machining residue that is slung in the direction of the operator. In addition, a "breakdown of the tool" is intended to mean, in particular, a tool that bursts during operation of the hand-held power tool, in which case individual tool parts may be slung outwardly due to rotation of the tool. Due to the inventive design of the hand-held power tool system, it is possible to protect an operator of the hand-held power tool—in an effective and, in particular, reliable manner—from a tool that rotates during operation of the hand-held power tool, and, in particular, from pieces of the tool that are slung in the direction of the operator if the tool becomes damaged, e.g., if the tool should burst. Advantageously, a sizing of the guard anti-rotation lock unit is designed to absorb forces that occur when the tool becomes damaged, these forces being transferred from pieces of the burst tool that strike the guard unit to the guard unit itself, when the guard unit is in an anti-rotation lock position with the hand-held power tool. Advantageously, a position of the guard unit during breakdown of the tool is preferably maintained via the guard anti-rotation lock unit and an operation of the guard unit. In addition, in particular, a protective position and/or an anti-rotation lock position of the guard unit is designed as the working position of the guard unit, thereby making it possible for the anti-rotation lock position to be attained by an operator of the hand-held power tool system using a simple design. Particularly advantageously, the guard anti-rotation lock element is located, at least partially, on guard and/or a closing unit of the guard unit. A "closing unit" refers, in particular, to a unit that is preferably provided to attach the guard unit to the hand-held power tool, and that includes at least one closing element, e.g., a clamping band, a screw, a closing lever, etch, it being possible to attach the guard unit to the hand-held power tool using the closing unit in a form-fit and/or non-positive manner. In addition, "located" is intended to mean, in particular, that the guard anti-rotation lock unit and the guard and/or the closing unit include a common installation unit and that they may be installed in an operating position on the hand-held power tool in the same installation procedure.

A particularly stable anti-rotation lock between the guard unit and the hand-held power tool may be attained using a simple design when the guard anti-rotation lock includes a non-positive connection unit and/or form-fit connection unit, which are/is provided to establish a non-positive and/or form-fit connection between the guard unit and the hand-held power tool.

It is also provided that the guard anti-rotation lock unit includes at least one anti-rotation lock element located on the guard unit, and an anti-rotation lock element located on the hand-held power tool, which are located at least partially in an anti-rotation lock position when the guard unit is in the working position, thereby making it advantageously possible to realize an effective anti-rotation lock when the guard unit is in a working position, thereby providing a high standard of safety for an operator.

If, in addition, the anti-rotation lock element is formed at least partially by a detent element that is provided to block a motion of the guard unit in at least one direction, it is advantageously possible to prevent rotation of the guard unit—in particular if a tool should burst—and to make it easier, at least partially, for an operator of the hand-held power tool system to change the position of the guard unit. Preferably, a blocking direction of the detent element corresponds to a rotational direction of a tool, thereby making it possible for an advantageous anti-rotation lock to be attained if the tool should break down.

Furthermore, additional components, installation space, assembly effort and costs may be advantageously saved when the anti-rotation lock element is designed as a single piece with a closing unit and/or a guard of the guard unit. The term "single piece" is intended to mean, in particular, one piece, cast, and/or designed as one component.

When the closing unit includes at least one closing element on which the anti-rotation lock element is located, it is possible to provide an operator with an anti-rotation lock of the guard unit that is easy to install.

A particularly easy means for attaching and removing the guard unit to/from the hand-held power tool may be advantageously attained when the anti-rotation lock element is movably supported on a closing unit and/or a guard of the guard unit. The anti-rotation lock element is preferably located such that it may be moved manually by an operator to release the anti-rotation lock position into an unlocked position. This may be attained in a particularly advantageous manner when the anti-rotation lock element is supported on the closing unit and/or on the guard such that it may move at least partially around a swivel axis.

In an alternative embodiment of the present invention, it is provided that the guard anti-rotation lock unit includes at least one lever element on which the anti-rotation lock element is at least partially located, by way of which the anti-rotation lock element may be advantageously moved into an anti-rotation lock position and/or into an inactive position using the lever element. Particularly advantageously, the lever element is rotatably supported on the hand-held power tool and/or the guard unit.

It is further provided that the guard anti-rotation lock unit includes at least one moving element that moves the anti-rotation lock element into an anti-rotation lock position when the guard unit reaches its working position, thereby resulting in an at least partially automatic fixing mechanism or moving mechanism that is independent of an operator in order to attain an anti-rotation lock position of the anti-rotation lock element and result in in a high safety standard for the operator independently of a manual actuation by the operator of the guard anti-rotation lock unit. The moving element is advantageously designed as a spring element and/or further moving elements that appear reasonable to one skilled in the technical art, e.g., a moving element designed as a magnet.

In an advantageous refinement of the present invention, it is provided that the guard anti-rotation lock unit includes at least one release element, which is provided to move the anti-rotation lock element out of the anti-rotation lock position. As a result, a means for advantageously removing the guard unit after a working process or after operation of the hand-held machine system may be attained. The release element is advantageously supported on the guard unit such that it is at least partially movable—the release element being preloaded in particular with spring loading in the anti-rotation lock position—thereby making it possible to install the release element in a compact manner and to advantageously secure the anti-rotation lock element in the anti-rotation lock position.

Furthermore, additional components, installation space, assembly effort and costs may be advantageously saved when the release element is designed at least partially as a single piece with the locking unit.

Advantageously, the hand-held power tool includes a receiving unit for accommodating a tool, on which the anti-rotation lock element is located, thereby making it possible, in particular, to provide a space-saving, compact guard anti-rotation lock unit by the fact that the anti-rotation lock element of the hand-held power tool is located on a component that is preferably located such that it has direct contact with the guard unit when the guard unit is in a working position.

It is also provided that the anti-rotation lock element is movably located on the receiving unit, by way of which a particularly easy means for attaching and removing the guard unit to the hand-held power tool may be advantageously attained.

Preferably, additional components, installation space, assembly effort and costs may also be saved when the anti-rotation lock element located on the receiving unit is designed at least partially as a single piece with the receiving unit.

When the guard anti-rotation lock unit includes at least two anti-rotation lock elements, which are located one after the other in the circumferential direction on the guard unit, and/or at least two anti-rotation lock elements, which are located one after the other in a circumferential direction on the hand-held power tool, in particular on its receiving unit, it is possible to attain a reusable form-fit and/or non-positive connection between the guard unit and the hand-held power tool, and/or the guard unit may be installed on the hand-held power tool in different positions along the circumferential direction in a non-rotating manner, in particular if a tool should burst. The term "circumferential direction" is intended to mean, in particular, a circumferential direction of the guard unit, which is oriented essentially parallel to a direction of rotation of the tool when the guard unit is in an installed state.

Particularly advantageously, the present invention includes a hand-held power tool for a rotating, preferably disk-shaped tool, with a machine housing that includes a flange and/or a machine neck, on which a guard—that is composed of sheet metal in particular—is detachably clampable in order to cover the tool. The guard includes a guard body, which is composed of a circular, disk-shaped piece, in particular with an outer edge located at a right angle thereto, and with a central, circular recess, on the edge of which a guard connection piece and/or collar is formed and that includes an annular clamping band that may be tightened using a clamping means. An anti-rotation lock that acts between the machine neck and the guard is located between the guard and the machine neck and is designed as a profiled structure. The guard may be repeatedly coupled via the clamping band and/or the clamping means in its clamping position in a form-fit and/or non-positive manner with the machine neck, and is therefore capable of being fixed in a non-rotatable position and, to attain a release position, may be disengaged from the form-fit and/or non-positive connection, so that the guard may then be adjusted in a rotational manner.

Further advantages result from the description of the drawing, below. Exemplary embodiments of the present invention are shown in the drawing. The drawing, the description, and the claims contain numerous features in combination. One skilled in the art will also advantageously consider the features individually and combine them to form further reasonable combinations.

DESCRIPTION OF THE PREFERRED EMBODIMENT

Figure 1:
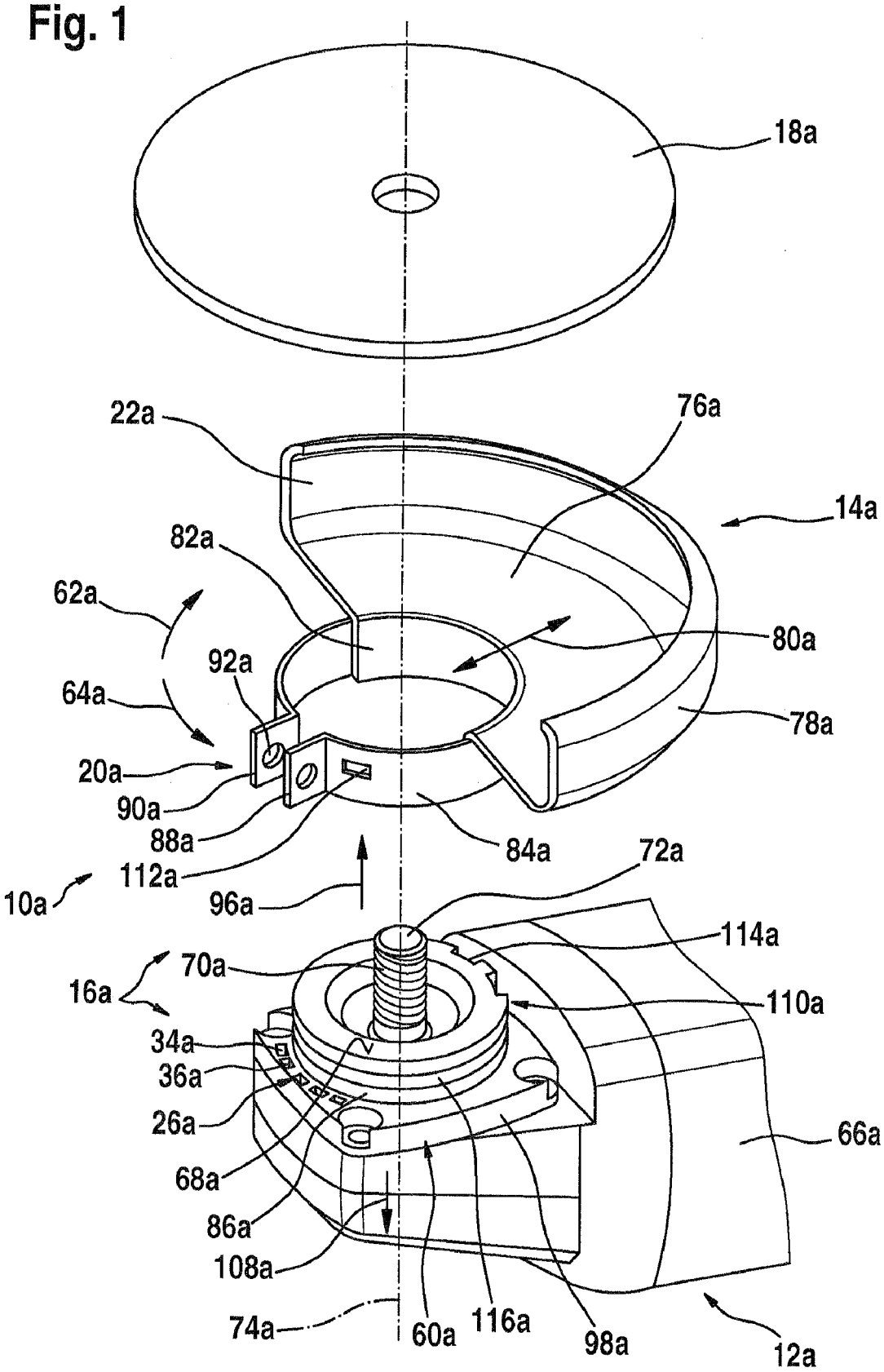
FIG. 1 shows an exploded view of an inventive hand-held power tool system.

FIG. 1 shows a hand-held power tool system 10*a* with a hand-held power tool 12*a* designed as an angle grinder, and with a guard unit 14*a* and a guard anti-rotation lock unit 16*a*. To accommodate guard unit 14*a* and/or a tool 18*a*, which is designed as a cutting disk, hand-held power tool 12*a* includes a receiving unit 60*a*, which is screwed together with hand-held power tool housing 66*a* of hand-held power tool 12*a*. A drive shaft 70*a* extends out of receiving unit 60*a* on a side 68*a* facing away from hand-held power tool housing 66*a*. Drive shaft 70*a* is connectable at its free end 72*a* with disk-shaped tool 18*a* and is rotationally drivable around an axis 74*a*. Guard unit 14*a* includes a guard 22*a* and a closing unit 20*a*, on which guard anti-rotation lock unit 16*a* is located. Guard 22*a* extends around an angular range of tool 18*a* of approximately 180° and, to this end, includes a semi-disk shaped guard body 76*a* and a guard edge 78*a*, which is initially oriented perpendicularly to semi-disk shaped body 76*a* and is finally oriented parallel to semi-disk shaped guard body 76*a*, inwardly in a radial direction 80*a*. Guard anti-rotation lock unit 16*a* is provided to prevent rotation between guard unit 14*a* and hand-held power tool 12*a* or receiving unit 60*a* during breakdown of tool 18*a*, e.g., if tool 18*a* should burst. The anti-rotation lock between guard unit 14*a* and hand-held power tool 12*a* takes place at the same time as guard unit 14*a* is attached to hand-held power tool 12*a*, when guard unit 14*a* is in a working position.

Figure 2A:
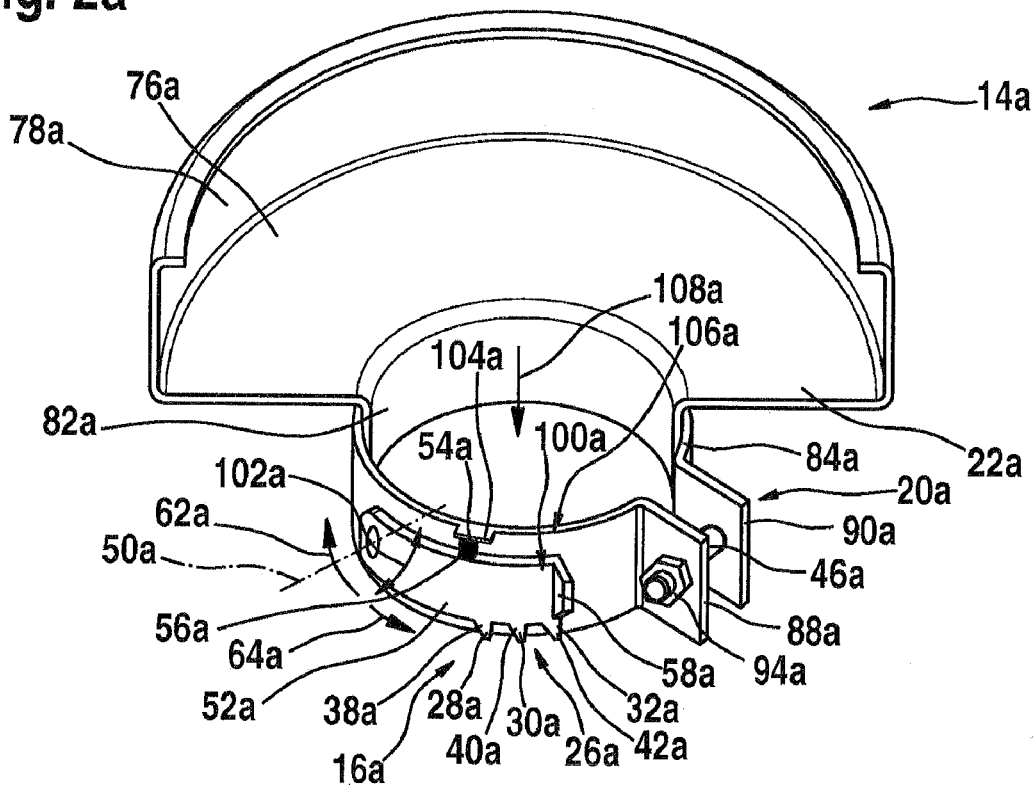
FIGS. 2*a*, 2*b* show the guard anti-rotation lock unit in FIG. 1 with an anti-rotation lock element that is movably supported on the clamping band, in a schematic partial view from above, in a first variant (FIG. 2*a*) and in a second variant (FIG. 2*b*)
Figure 2B:
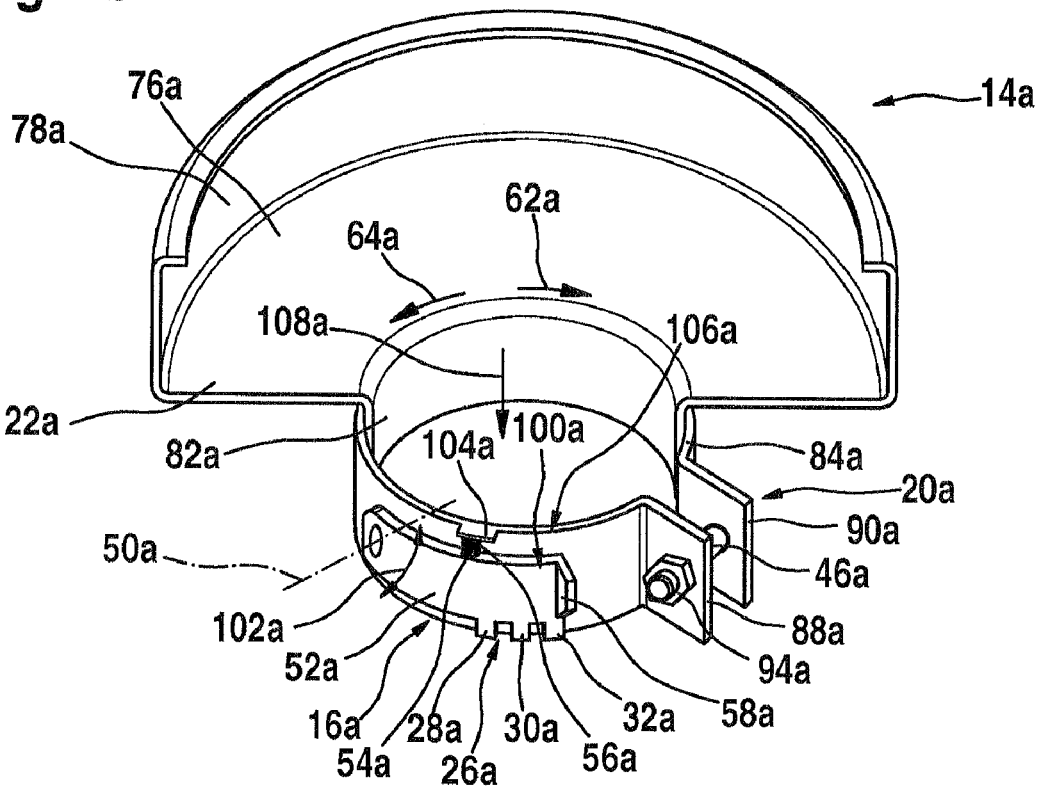

Guard unit 22*a* also includes a guard collar 82*a*, which is oriented essentially perpendicularly to semi-disk shaped guard body 76*a* (FIGS. 1, 2*a*, and 2*b*). Guard collar 82*a* is enclosed outwardly in radial direction 80*a* by a clamping band 84*a* of closing unit 20*a*. Guard collar 82*a* and clamping band 84*a* are interconnected via a welded connection. Guard collar 82*a*—together with clamping band 84*a*—is provided to attach guard unit 14*a* to hand-held power tool 12*a* and/or to receiving unit 60*a*, which includes a cylindrical receiving flange 86*a* for this purpose. Along a circumferential direction 62*a*, 64*a* of clamping band 84*a*, clamping band 84*a* includes two end regions 88*a*, 90*a* in a region that faces away from guard 22*a* and extends outwardly in radial direction 80*a*. End regions 88*a*, 90*a* each include a recess 92*a*, through which a clamping element 46*a*—designed as a clamping screw—of closing unit 20*a* extends. The clamping screw may be fastened in recesses 92*a* of clamping band 84*a* using a nut 94*a*. Guard 22*a* is attached in a working position to receiving unit 60*a* and/or on receiving flange 86*a* via closing unit 20*a* using a frictional connection between guard collar 82*a* and clamping band 84*a* and receiving flange 86*a*, so that guard unit 14*a* is positioned in a non-rotatable manner during regular operation of hand-held power tool 10*a*. In an alternative design of the closing unit, it is basically feasible to use—instead of the clamping screw—further closing elements 46*a*, e.g., a clamping lever and/or form-fit elements, etc.

Guard anti-rotation lock unit 16*a* prevents guard unit 14*a* from accidentally rotating if tool 18*a* should become damaged, in particular if tool 18*a* should burst. To this end, guard anti-rotation lock unit 16*a* includes a form-fit unit 26*a*, which is provided to establish a form-fit connection between guard unit 14*a* and receiving flange 86*a* of hand-held power tool 12*a*, a form-fit connection being established at the same time that guard unit 14*a* is attached to receiving flange 86*a* in a working position. To establish the form-fit connection, form-fit unit 26*a* and/or guard anti-rotation lock unit 16*a* include three anti-rotation lock elements 28*a*, 30*a*, 32*a*—each of which is designed as a form-fit element, and which are located on clamping band 84*a* of closing unit 20*a*—and several anti-rotation lock elements 34*a*, 36*a* formed by form-fit elements, and which are designed as a single piece with receiving unit 60*a*. Anti-rotation lock elements 34*a*, 36*a* located on receiving unit 60*a* are designed as detent recesses, and they are located one after the other in circumferential direction 62*a*, 64*a* around receiving flange 60*a*. Anti-rotation lock elements 34*a*, 36*a* are designed open in a direction 96*a* that extends away from receiving unit 60*a* in the direction of tool 18*a* and parallel to axis 74*a*, and which are located on a main element 98*a* of receiving unit 60*a*, which is oriented essentially perpendicularly to axis 74*a*. The location of anti-rotation lock elements 34*a*, 36*a* makes it possible to attach guard unit 14*a* to hand-held power tool 12*a* in different working positions in circumferential direction 62*a*, 64*a*.

The three anti-rotation lock elements 28*a*, 30*a*, 32*a* of guard unit 14*a* are located one after the other in circumferential direction 62*a*, 64*a*, and are designed as detent elements 38*a*, 40*a*, 42*a*, which block a motion of guard unit 14*a* in one direction, when guard unit 14*a* is in an installed state (FIG. 2*a*). A blocking direction is a rotational direction of tool 18*a* that ensures that, if tool 18*a* should burst, guard unit 14*a* remains attached in its protective position. To this end, detent elements 38*a*, 40*a*, 42*a* are cut at an angle and have an essentially triangular cross-sectional area, so that, when a fastening means and/or the clamping screw are/is loosened, guard 22*a* may be rotated in a direction that is opposite to the rotational direction of tool 18*a* during operation of hand-held power tool 12*a* (FIG. 2*a*). As an alternative, anti-rotation lock elements 28*a*, 30*a*, 32*a* in FIG. 2*b* are provided with an essentially rectangular cross-sectional area that serves to prevent guard 22*a* from rotating in either direction of circumferential direction 62*a*, 64*a*.

Anti-rotation lock elements 28*a*, 30*a*, 32*a* are movably supported on clamping band 84*a*. To this end, guard anti-rotation lock unit 16*a* includes a lever element 52*a* that is located on clamping band 84*a* such that it may swivel around swivel axis 50*a*. When guard unit 14*a* is installed on hand-held power tool 12*a*, swivel axis 50*a* of lever element 52*a* is oriented essentially perpendicular to axis 74*a* and extends away from axis 74*a* in a radial direction 80*a*. Anti-rotation lock elements 28*a*, 30*a*, 32*a* are located on an end 100*a* of lever element 52*a* facing away from swivel axis 50*a* and extend in the manner of projections along a swivel direction 102*a* around swivel axis 50*a* on lever element 52*a*. When guard unit 14*a* is in a working position, anti-rotation lock elements 28*a*, 30*a*, 32*a* are located on a side of lever element 52*a* facing anti-rotation lock elements 34*a*, 36*a*.

Guard anti-rotation lock unit 16*a* also includes a moving element 54*a*, which is designed as a spring element 56*a* and moves lever element 52*a* and/or anti-rotation lock elements 28*a*, 30*a*, 32*a* into an anti-rotation lock position when guard unit 14*a* reaches a working position, during installation on hand-held power tool 12*a*. As a result, anti-rotation lock elements 28*a*, 30*a*, 32*a* are always in the anti-rotation lock position as soon as guard unit 14*a* is installed in the working position. Spring element 56*a* bears against a support element 104*a* of clamping band 84*a*. Support element 104*a* is located along axis 74*a* on a region 106*a* facing away from anti-rotation lock elements 28*a*, 30*a*, 32*a*, and a spring force of lever element 52*a* presses along axis 74*a* in a direction 108*a* facing away from tool 18*a*. To release the anti-rotation lock position of anti-rotation lock elements 28*a*, 30*a*, 32*a*, lever element 52*a* includes a release element 58*a*, which is designed as a tab, and which is located on end 100*a* of lever element 52*a* facing away from swivel axis 50*a* and extends outwardly on lever element 52*a* along radial direction 80*a*, so that an operator may move lever element 52*a*—using the tab—along with anti-rotation lock elements 28*a*, 30*a*, 32*a*, out of the anti-rotation lock position along swivel direction 102*a*. It is also feasible, in principle, for closing unit 20*a* to be closable only when anti-rotation lock elements 28*a*, 30*a*, 32*a* are located in an anti-rotation lock position. To remove and/or change the position of guard unit 14*a* in circumferential direction 62*a*, 64*a*, closing unit 20*a* must be released and, if rotation is locked in both directions, guard anti-rotation lock unit 16*a* must also be moved out of its anti-rotation lock position, so that anti-rotation lock elements 28*a*, 30*a*, 32*a* are disengaged from recesses in receiving unit 60*a* and guard unit 14*a* may rotate and/or be removed relative to hand-held power tool 12*a*.

Hand-held power tool system 10*a* also includes a coding device 110*a*, which is provided to prevent tools 18*a* and/or tools 18*a* together with guard unit 14*a* from being installed on unsuitable hand-held power tools 12*a*. To this end, clamping band 84*a* includes a coding element 112*a* of coding device 110*a*, which is designed as a single piece with clamping band 84*a*. Coding device 112*a* is designed as a pressed-out region that extends inwardly in radial direction 80*a* and has a rectangular shape. Correspondingly, receiving flange 86*a* includes a coding element 114*a* of coding device 110*a*, which is designed as a recess into which coding means 112*a* of clamping band 84*a* may be inserted when guard unit 14*a* is installed on hand-held power tool 12*a*. After guard unit 14*a* has been inserted onto receiving unit 60*a*, guard unit 14*a* may be rotated into a working position. To this end, receiving flange 86*a* includes a groove 116*a* that extends in circumferential direction 62*a*, 64*a*, in which coding element 112*a* is guided when guard unit 14*a* is rotated into the working position.

Alternative exemplary embodiments are shown in FIGS. 3 through 15. Components, features, and functions that are essentially the same are labelled with the same reference numerals. To distinguish the exemplary embodiments from each other, the reference numerals of the exemplary embodiments are appended with the letters a through n. The description below is essentially limited to the differences from the exemplary embodiment in FIGS. 1 and 2. With regard for the components, features, and functions that remain the same, reference is made to the description of the exemplary embodiment in FIGS. 1 and 2.

Figure 3:
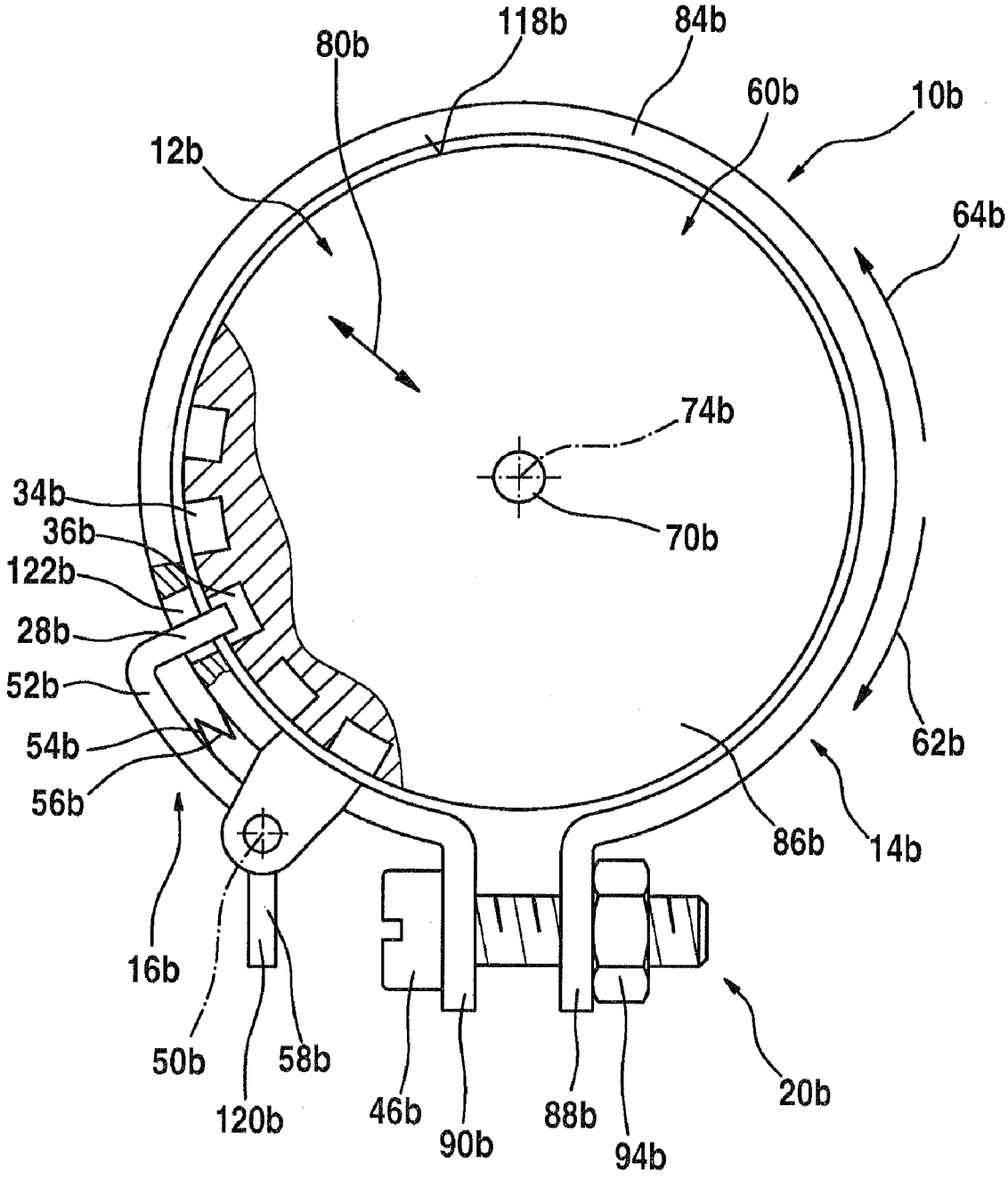
FIG. 3 shows the guard anti-rotation lock unit with an alternative anti-rotation lock element that is movably supported on the clamping band, in a schematic cross-sectional view.

FIG. 3 shows a hand-held power tool system 10*b* in a partial cross section with a receiving unit 60*b* of a hand-held power tool 12*b*, and with a clamping band 84*b* of a guard unit 14*b*, and a guard anti-rotation lock unit 16*b*. Guard anti-rotation lock unit 16*b* is provided to prevent rotation between guard unit 14*b* and hand-held power tool 12*b* at the same as guard unit 14*b* reaches a working position during installation. To this end, guard anti-rotation lock unit 16*b* includes an anti-rotation lock element 28*b* located on clamping band 84*b* of a closing unit 20*b*, and several anti-rotation lock elements 34*b*, 36*b* located on receiving unit 60*b*. Anti-rotation lock elements 34*b*, 36*b* located on receiving unit 60*b* are designed as recesses, which are located one after the other in a circumferential direction 62*b*, 64*b* on a receiving flange 86*b* of receiving unit 60*b*. The recesses extend radially inwardly from a radially outwardly oriented surface 118*b* of receiving flange 86*b*. Anti-rotation lock element 28*b* located on closing unit 20*b* is located on a lever element 52*b* of guard anti-rotation lock unit 16*b*. Lever element 52*b* is swivelably supported on clamping band 84*b*. Swivel axis 50*b* of lever element 52*b* is oriented essentially perpendicularly to a circumferential direction 62*b*, 64*b* of clamping band 84*b*. To fix lever element 52*b* together with anti-rotation lock element 28*b* in an anti-rotation lock position, lever element 52*b* bears against clamping band 84*b* via a moving element 54*b* designed as a spring element 56*b*. Spring element 56*b* is designed as a tension spring that is located in radial direction 80*b* between clamping band 84*b* and an inward—in radial direction 80*b*—surface of lever element 52*b*. Lever element 52*b*, together with anti-rotation lock element 28*b*, is moved and/or pulled inwardly by spring element 56*b* around swivel axis 50*b*, and it is brought into an anti-rotation lock position, i.e., in engagement with anti-rotation lock elements 34*b*, 36*b* of receiving flange. Clamping band 84*b* also includes a recess 122*b*, through which anti-rotation lock element 28*b* engages with receiving flange 86*b* in an anti-rotation lock position. On an end 120*b* facing away from anti-rotation lock element 28*b*, lever element 52*b* includes a release element 58*b* designed as a tab, via which lever element 52*b* may be moved by an operator from its anti-rotation lock position against a spring force of spring element 56*b*. An operator may release a clamping closing element 46*b*, which is designed as a clamping screw, only after lever element 52*b* has been moved out of its anti-rotation lock position.

Figure 4B:
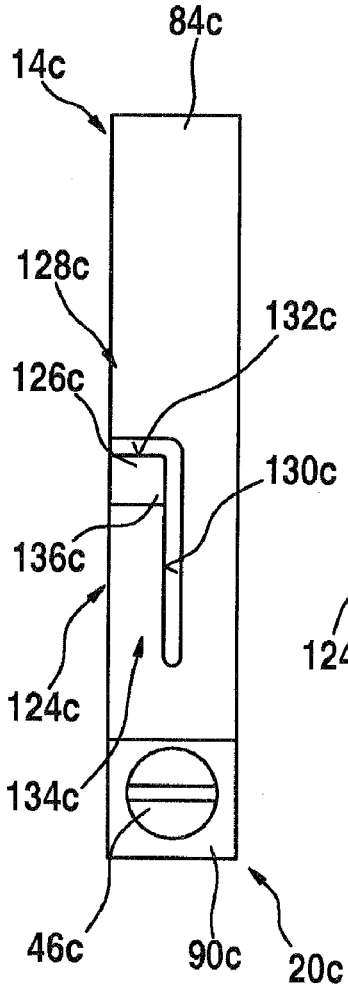
FIGS. 4*a* and 4*b* show a guard anti-rotation lock unit with an anti-rotation lock element designed as a single piece with a clamping band, and with a positioning unit, in a schematic partial view from above (FIG. 4*a*) and in a schematic side view (FIG. 4*b*)
Figure 4A:
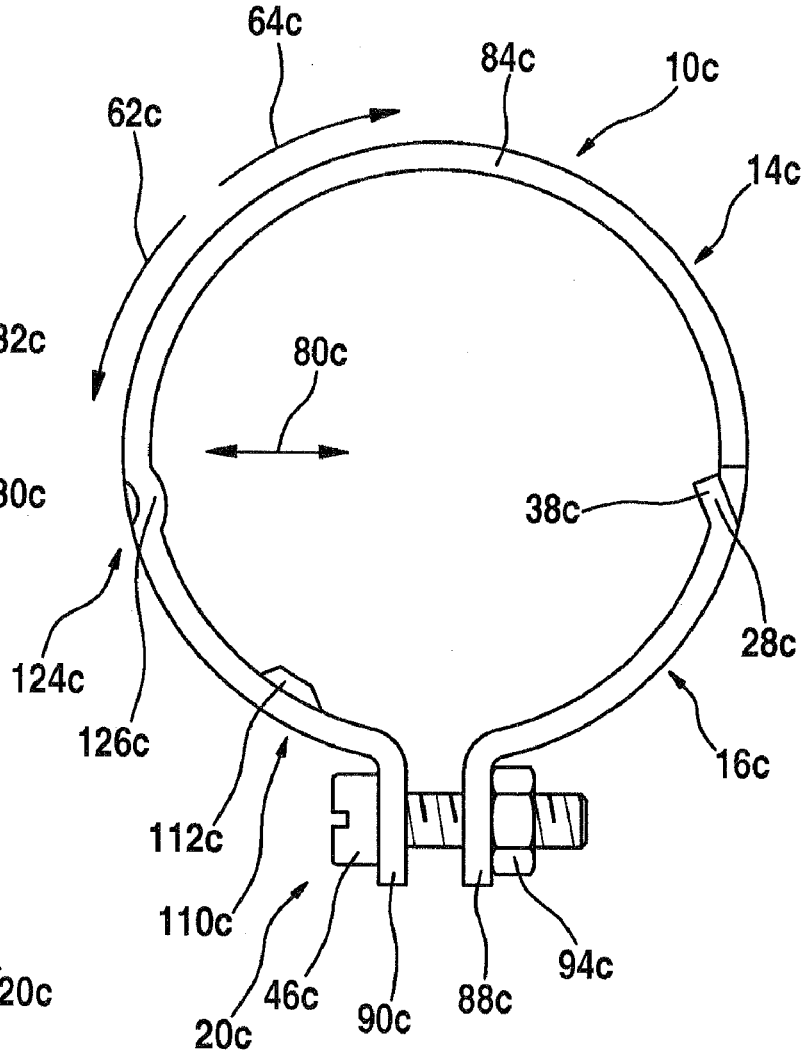

FIG. 4*a* shows a hand-held power tool system 10*c* with a guard anti-rotation lock unit 16*c*, as a partial cross-section, with an anti-rotation lock element 28*c* of a guard unit 14*c* whose design is an alternative to that shown in FIG. 3. Guard anti-rotation lock unit 16*c* is provided to prevent rotation between guard unit 14*c* and a not-shown hand-held power tool at the same as guard unit 14*c* reaches a working position during installation. Anti-rotation lock element 28*c* is designed as a hook-shaped detent element 38*c*. In addition, detent element 38*c* is designed as a single piece with a clamping band 84*c* of a closing unit 20*c*. Detent element 38*c* of clamping band 84*c* is located such that it is bent inwardly. Detent element 38*c* therefore prevents rotation in a manner analogous to that described with reference to FIG. 2*a* and enables rotation in a direction opposite to a rotational direction of the tool when closing element 46*c*—which is designed as a clamping screw—of closing unit 20*c* is loosened.

To make it easier for an operator to attach guard unit 14*c* and/or to change the position of installed guard unit 14*c* on a receiving flange, hand-held power tool system 10*c* includes a positioning device 124*c*. Guard unit 14*c* includes a positioning element 126*c* of positioning device 124*c*, which is designed as a single piece with clamping band 84*c* (FIGS. 4*a* and 4*b*). Positioning element 126*c* is located in an edge region 128*c* of clamping band 84*a*. When guard unit 14*c* is installed, edge region 128*c* faces away from the tool. Positioning element 126*c* is designed as a segment in circumferential direction 62*c*, 64*c*. Positioning element 126*c* is punched out of clamping band 84*c* along two sides 130*c*, 132*c* that face clamping band 84*a*, and it is located in an end region 134*c* in circumferential direction 62*c*, 64*c* on clamping band 84*c* (FIG. 4*b*). On a free end 136*c* in circumferential direction 62*c*, 64*c*, positioning element 126*c* includes a pressed-out region that extends inwardly in radial direction 80*c* and has a contour that is essentially identical in shape to a contour of a not-shown positioning element of a receiving flange.

Figure 5:
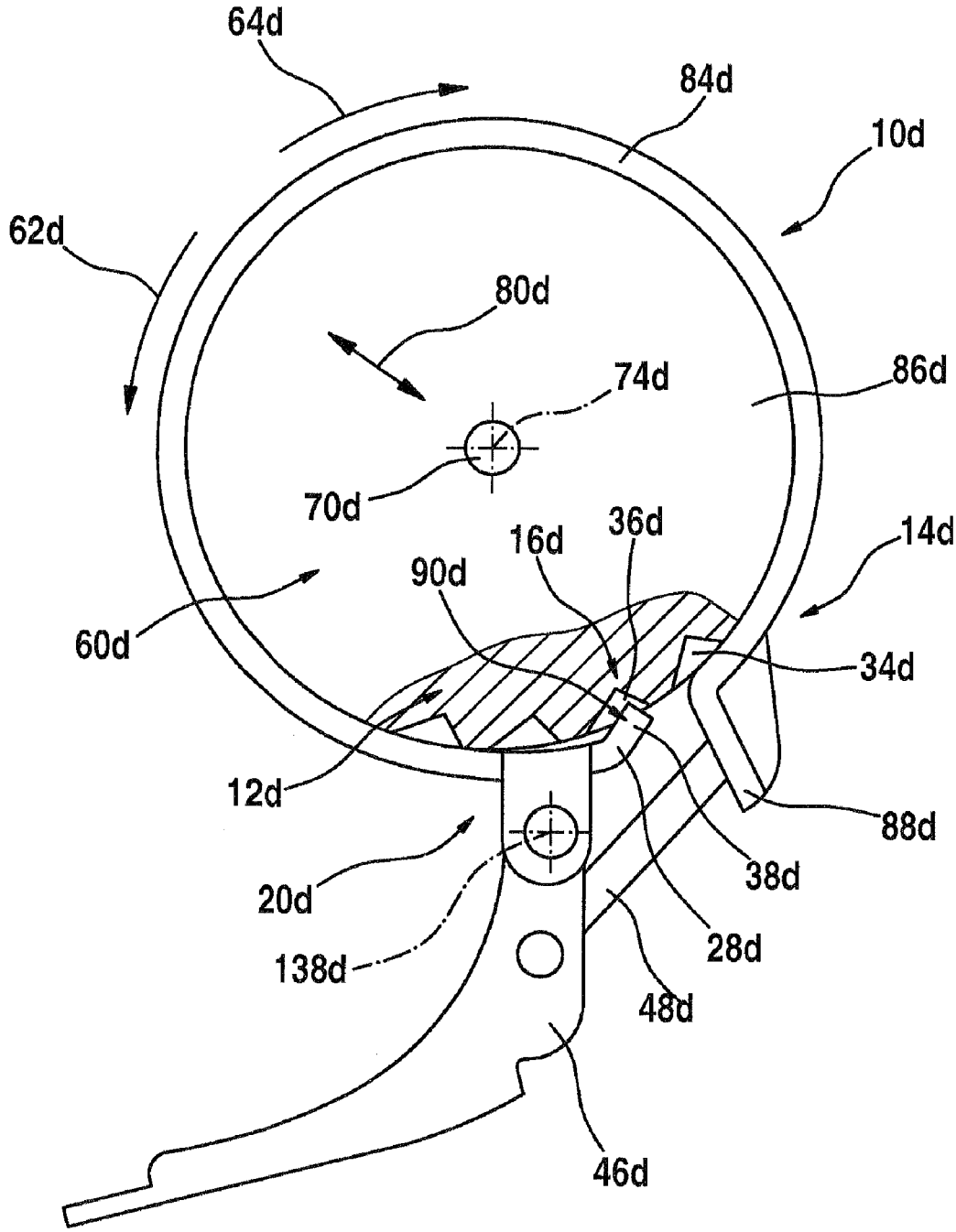
FIG. 5 shows a guard anti-rotation lock unit with an anti-rotation lock element designed as a single piece with a clamping band, in the region of a closing element, in a schematic partial view.

FIG. 5 shows a hand-held power tool system 10*d* with a guard anti-rotation lock unit 16*d* in a partial cross-sectional view. Guard anti-rotation lock unit 16*d* is provided to prevent rotation between a guard unit 14*d* and a hand-held power tool 12*d*—which is not shown in detail—at the same time as guard unit 14*d* reaches a working position during installation. Guard anti-rotation lock unit 16*d* differs from the exemplary embodiment shown in FIGS. 4*a* and 4*b* in that an anti-rotation lock element 28*d* of guard anti-rotation lock unit 16*d* is located in an end region 90*d*—located in circumferential direction 62*d*, 64*d*—of a clamping band 84*d* of a closing unit 20*d*. Anti-rotation lock element 28*d* is designed as a single piece with clamping band 84*d* and is bent inwardly relative to clamping band 84*d*. Guard anti-rotation lock unit 16*d* also includes several anti-rotation lock elements 34*d*, 36*d* designed as a detent recess in a receiving unit 60*d* of hand-held power tool 12*d*. Guard anti-rotation lock unit 16*d* functions in a manner analogous to that described with reference to FIGS. 2*a*, 4*a*, and 4*b*. Closing unit 20*d* also includes a closing element 46*d*, 48*d* on each of the end regions 88*d*, 90*d* of clamping band 84*d*, along circumferential direction 62*d*, 64*d*. Closing elements 46*d*, 48*d* are designed as a screw and a closing lever. The screw connects one of the end regions 88*d* of clamping band 84*d* with the clamping lever located on further end region 90*d*. The screw is rotatably supported at end region 88*d*, and it extends in circumferential direction 64*d* away from end region 88*d* in the direction toward the closing lever to a bearing point and/or a rotation axis 138*d* of the closing lever with end region 90*d*. A guard is attached in a working position via closing unit 20*d* on receiving unit 60*d* and/or on receiving flange 86*d* of receiving unit 60*d* via a frictional connection between a guard collar and/or clamping band 84*d* and receiving flange 86*d*. In addition, an operator may adjust an effective fastening force using the screw when fastening between guard unit 14*d* and receiving flange 86*f*.

Figure 6:
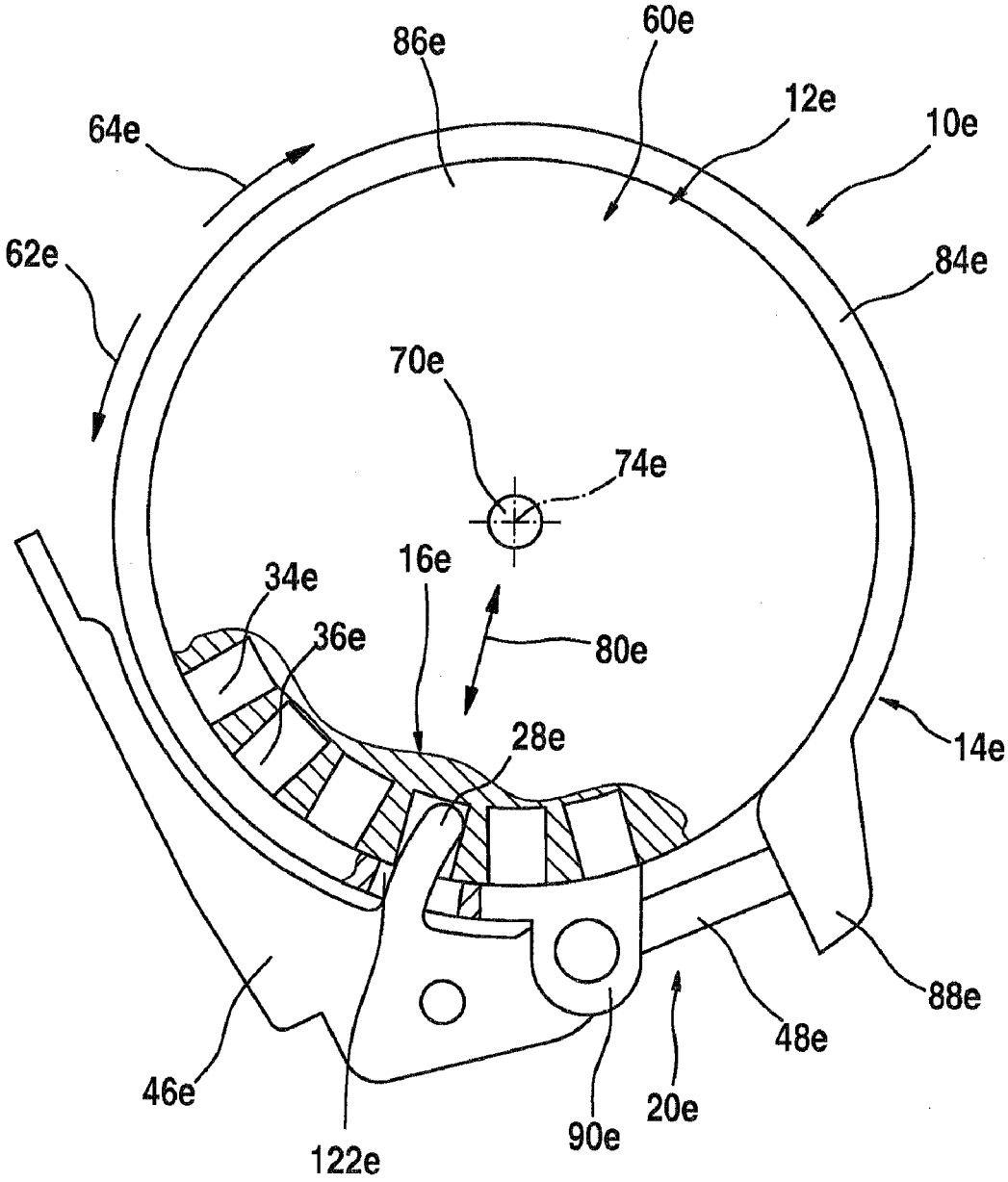
FIG. 6 shows the guard anti-rotation lock unit of an anti-rotation lock element designed as a single piece with a closing element, in a schematic partial view.

FIG. 6 shows a partial cross-sectional view of a hand-held power tool system 10*e* with a guard anti-rotation lock unit 16*e*. Guard anti-rotation lock unit 16*d* is provided to prevent rotation between a guard unit 14*d* and a hand-held power tool 12*e* not shown in detail at the same time as guard unit 14*e* reaches a working position during installation, and, to this end, includes an anti-rotation lock element 28*e* designed as a detent cam, which is designed as a single piece with a closing element 46*e* of a closing unit 20*e*. Closing unit 20*e* is designed as described with reference to FIG. 5, with anti-rotation lock element 28*e* being located on a clamping lever and extending—when closing unit 20*e* is in a closed state—inwardly in a radial direction 80*e*. When anti-rotation lock element 28*e* is located in an anti-rotation lock position and/or when guard unit 14*e* is installed in a working position on hand-held power tool 12*e*, anti-rotation lock element 28*e* extends into one of several anti-rotation lock elements 34*e*, 36*e* designed as recesses, which are located in a receiving flange 86*e* of a receiving unit 60*e* as described with reference to FIG. 3. Clamping band 84*e* also includes a recess 122*e*, through which anti-rotation lock element 28*e* extends to attain an anti-rotation lock position.

Figure 7A:
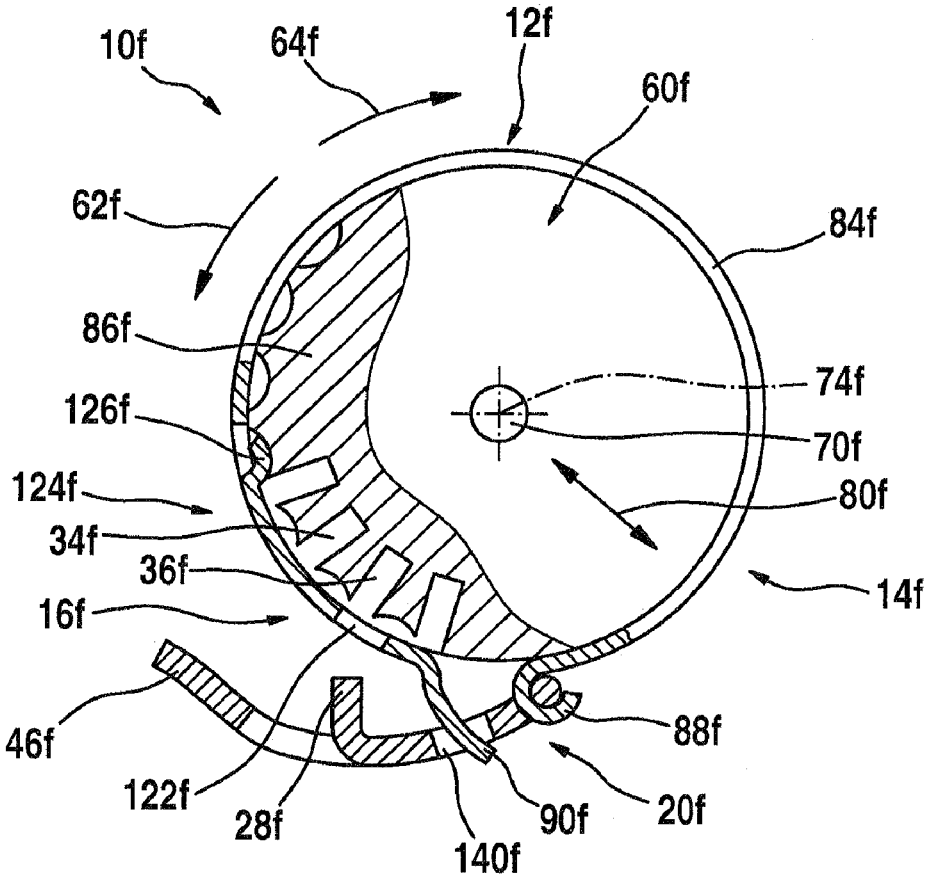
FIGS. 7*a*, 7*b*, 7*c* show the hand-held power tool system with a positioning unit and the guard anti-rotation lock unit, and a closing unit designed as an alternative to that shown in FIG. 6, and in a schematic partial view (FIG. 7*a*), in a side view (FIG. 7*b*), and in a further alternative embodiment, in a side view (FIG. 7*c*)

FIG. 7*a* shows a partial cross-sectional view of a hand-held power tool system 10*f* with a guard anti-rotation lock unit 16*f*. Guard anti-rotation lock unit 16*f* is provided to prevent rotation between a guard unit 14*f* and a hand-held power tool 12*f* not shown in detail at the same time as guard unit 14*f* reaches a working position during installation, and, to this end, includes an anti-rotation lock element 28*f* designed as a detent cam, which is designed as a single piece with a closing element 46*f* of a closing unit 20*f*. Closing element 46*f* is designed as a clamping lever, which is rotatably supported at an end region 88*f*—designed as an eyelet—of a clamping band 84*f*. The clamping lever includes a recess 140*f*, through which a further end region 90*f* of clamping band 84*f* extends. End region 90*f* has a contour that increases continually and outwardly, as viewed from clamping band 84*f*, so that, when closing unit 20*f* is closed, a clamping band diameter is reduced and an effective non-positive connection may be established between guard unit 14*f* and a receiving unit 60*f*. A design of clamping band 84*f* and receiving unit 60*f* to attain an anti-rotation lock position is similar to that described with reference to FIG. 6. Hand-held power tool system 10*f* shown in FIGS. 7*a* and 7*b* also includes a positioning device 124*f*, which is designed as described with reference to FIGS. 4*a* and 4*b*.

Figure 7B:
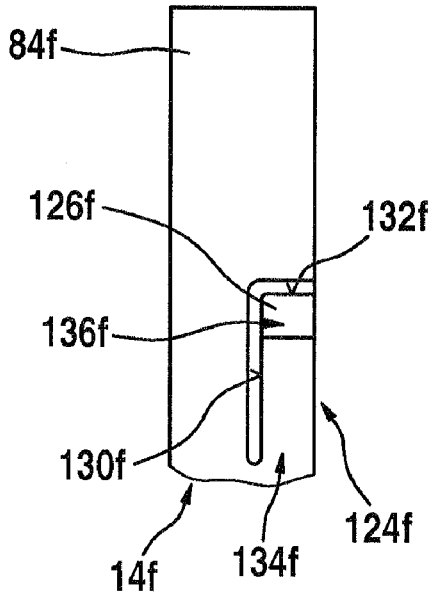
Figure 7C:
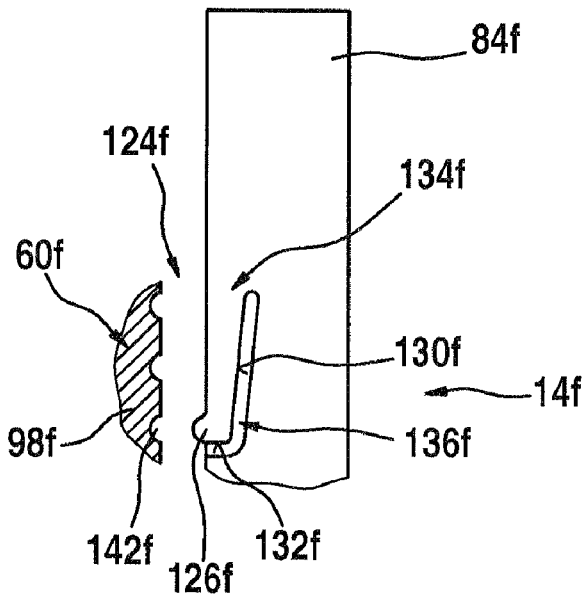

FIG. 7*c* shows an embodiment of a positioning device 124*f* that is an alternative to the design shown in FIGS. 7*a* and 7*b*. A positioning element 126*f* extends on clamping band 84*f* perpendicularly to a circumferential direction 62*f*, 64*f* of clamping band 84*f* and faces away from a tool when guard unit 14*f* is in an installed state. For locking into position, positioning elements 142*f* of positioning device 124*f* that are designed as grooves are located on receiving unit 60*f*. Positioning elements 142*f* are located one after the other in a circumferential direction 62*f*, 64*f* around a receiving flange 86*f* on a main element 98*f* of receiving unit 60*f*.

Figure 8A:
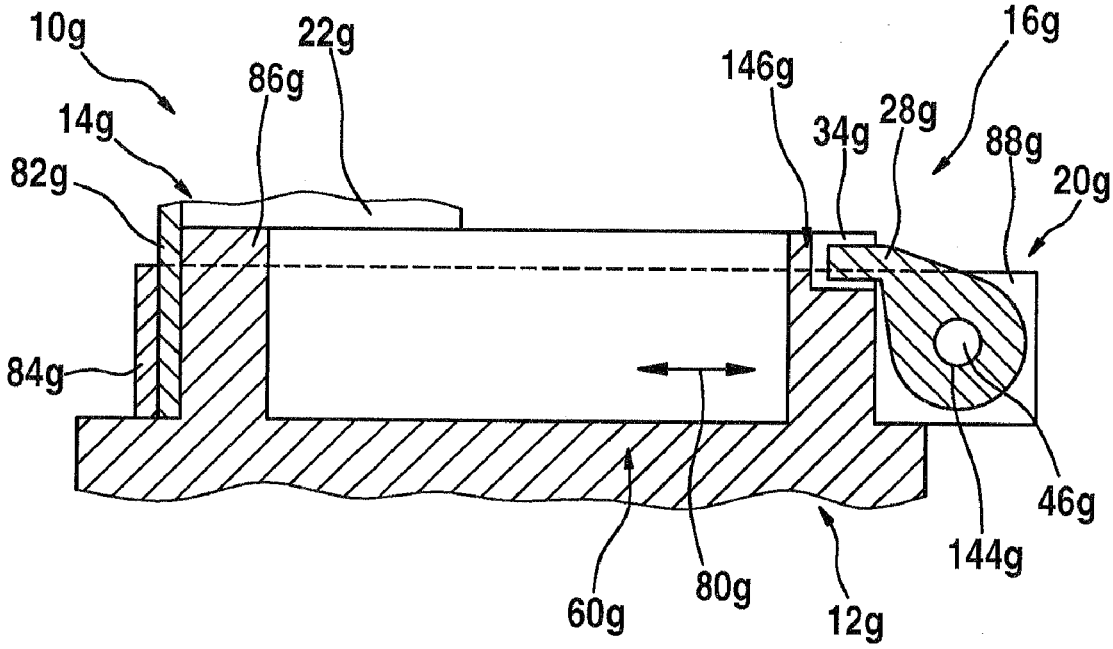
FIGS. 8*a*, 8*b* show a guard anti-rotation lock unit with an anti-rotation lock element that is movably supported on a closing element, in a schematic side view (FIG. 8*a*), and in a perspective view (FIG. 8*b*)
Figure 8B:
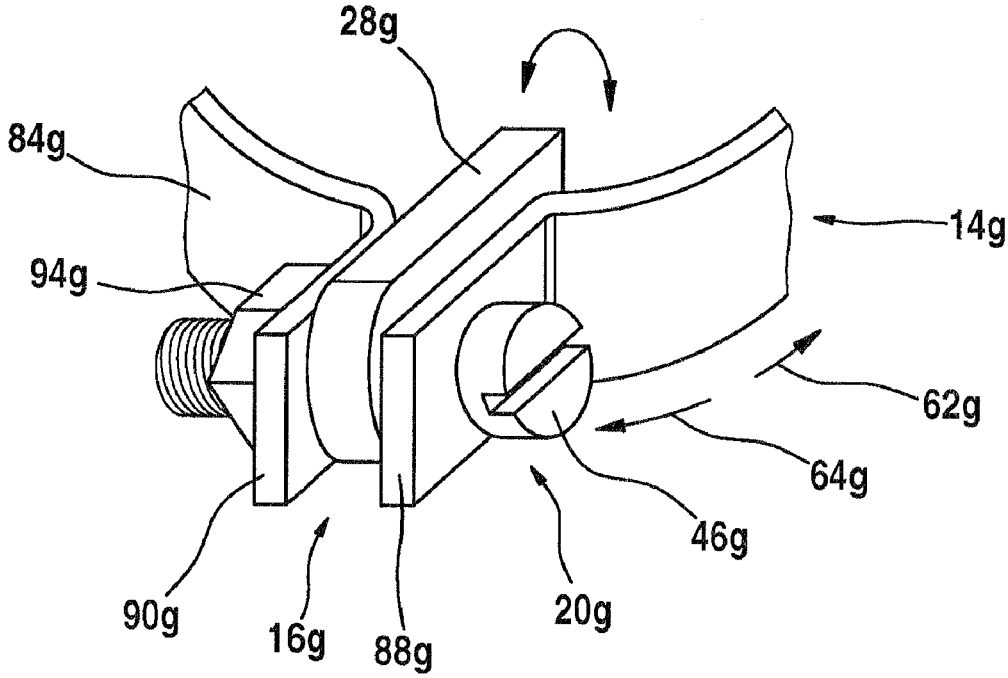

FIGS. 8*a* and 8*b* show a partial cross-sectional view of a hand-held power tool system log with a guard anti-rotation lock unit 16*g*. Guard anti-rotation lock unit 16*g* is provided to prevent rotation between a guard unit 14*g* and a hand-held power tool 12*g* not shown in detail at the same time as guard unit 14*g* reaches a working position during installation, and, to this end, includes an anti-rotation lock element 28*g* designed as a detent cam, which is movably supported on a closing element 46*g* of a closing unit 20*g*. To this end, anti-rotation lock element 28*g* includes a recess 144*g*, through which closing element 46*g* extends. Closing element 46*g* is designed as a clamping screw, similar to that shown in FIG. 1. Motion in an anti-rotation lock position takes place when a guard unit 14*g* is attached in a working position in that anti-rotation lock element 28*g* is moved into the anti-rotation lock position via a frictional connection with the clamping screw (FIG. 8*b*). As an alternative, a form-fit connection between the clamping screw and anti-rotation lock element 28*g* is also feasible. In addition, a receiving flange 86*g* includes several anti-rotation lock elements 34*g* designed as recesses, only one of which is shown in FIG. 8*a*. The recesses are located in a receiving flange 86*g* along a circumferential direction 62*g*, 64*g*, on after the other, in an edge region 146*g* located outwardly in radial direction 80*g*.

Figure 9:
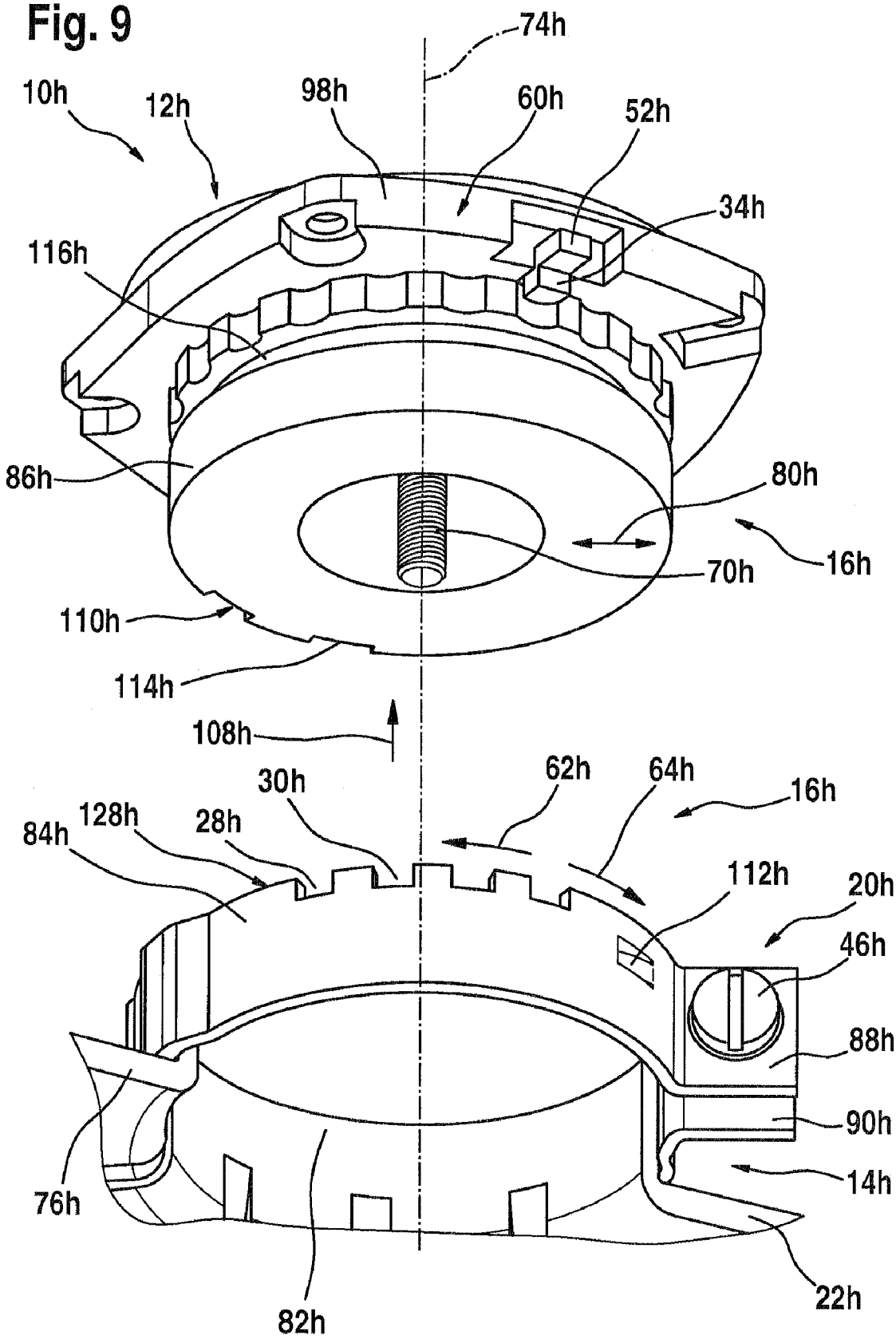
FIG. 9 shows a guard anti-rotation lock unit with an anti-rotation lock element that is movably supported on a receiving unit, in an exploded view.

FIG. 9 shows a hand-held power tool system 10*h* with a guard anti-rotation lock unit 16*h*, a receiving unit 60*h*, and a guard unit 14*h*. Guard anti-rotation lock unit 16*h* is provided to prevent rotation between a guard unit 14*h* and a hand-held power tool 12*h* at the same time as guard unit 14*h* reaches a working position during installation, and, to this end, includes an anti-rotation lock element 34*h*, which is movably supported on receiving unit 60*h*. Anti-rotation lock element 34*h* is located on a main element 98*h* of receiving unit 60*h* and extends outwardly away from a receiving flange 86*h* in a radial direction 80*h*. To ensure that guard unit 14*h* remains in an anti-rotation lock position on receiving flange 86*h* when in a working position, anti-rotation lock element 34*h* is held in an anti-rotation lock position by a not-shown spring element. Moreover, anti-rotation lock element 34*h* is designed as a single piece with a lever element 52*h*, with which an operator may manually release anti-rotation lock element 34*h* from the anti-rotation lock position. A clamping band 84*h* of a closing unit 20*h* also includes several anti-rotation lock elements 28*h*, 30*h* designed as recesses, which are located one after the other in a circumferential direction 62*h*, 64*h* on clamping band 84*h*. When guard unit 14*h* is in an installed state, the recesses are located in an edge region 128*h* of clamping band 84*h* that faces main element 98*h*.

Figure 10:
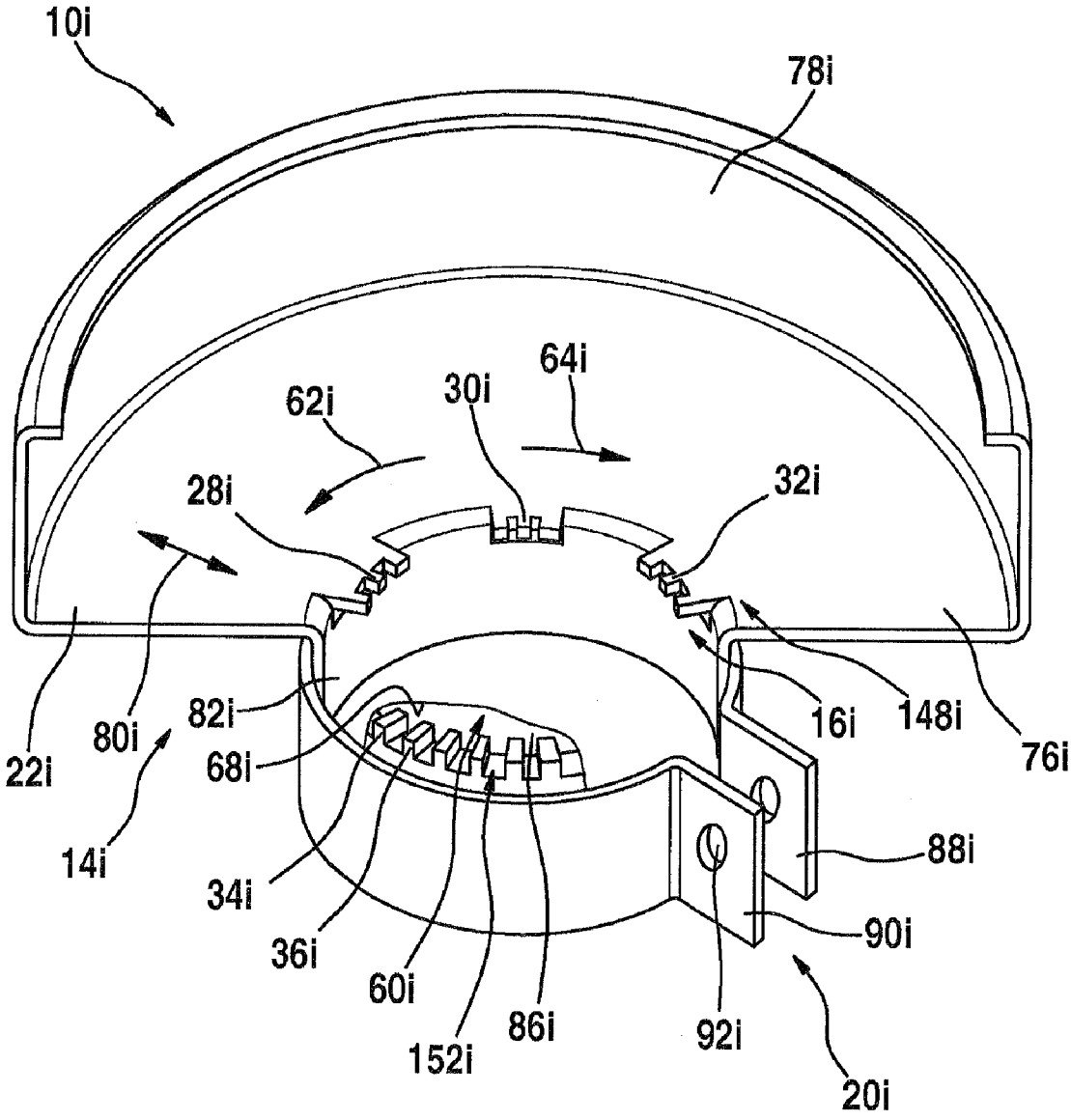
FIG. 10 shows a guard anti-rotation lock unit, which is located as a single piece on a guard of a guard unit, in a perspective view.

FIG. 10 shows a hand-held power tool system 10*i* with a guard anti-rotation lock unit 16*i*, a receiving unit 60*i*—which is shown only partially—and a guard unit 14*i*. Guard anti-rotation lock unit 16*i* is provided to prevent rotation between a guard unit 14*i* and a hand-held power tool at the same time as guard unit 14*i* reaches a working position during installation, and, to this end, includes three anti-rotation lock elements 28*i*, 30*i*, 32*i*, which are designed as one piece with a guard 22*i* of guard unit 14*i*. The three anti-rotation lock elements 28*i*, 30*i*, 32*i* of guard unit 14*i* are designed as toothing, and they are located one after the other in circumferential direction 62*i*, 64*i*. The toothing is located on an edge region 148*i* of a guard body 76*i* of guard 22*i* that faces guard collar 82*i*, and extend away from guard 22*i* inwardly in radial direction 80*i* within a plane of guard body 76*i*, thereby being oriented essentially perpendicularly to a circumferential direction 62*i*, 64*i* of guard collar 82*i*. The toothing is formed as a single piece with guard 22*i* using a stamping-bending process. In addition, a receiving flange 86*i* of the hand-held power tool includes several anti-rotation lock elements 34*i*, 36*i*, which are designed as form-fit elements and are designed as a single piece with receiving flange 86*i*. Anti-rotation lock elements 34*i*, 36*i* located on receiving flange 86*i* form a toothing that extends in the circumferential direction. Anti-rotation lock elements 34*i*, 36*i* are located on a side 68*i* of receiving flange 86*i* in an outer—in radial direction 80*i*—edge region 152*i*. Side 68*i* faces a tool during operation of the hand-held power tool. As soon as guard unit 14*i* is located in a working position during installation on the hand-held power tool, anti-rotation lock elements 28*i*, 30*i*, 32*i*, 34*i*, 36*i* also engage with each other and/or are located in an anti-rotation lock position, and guard 22*i* is secured against accidentally rotating if a tool should burst during operation. Anti-rotation lock elements 28*i*, 30*i*, 32*i* of guard 22*i* engage in anti-rotation lock elements 34*i*, 36*i* during a procedure of inserting guard unit 14*i* on receiving unit 60*i* in a direction 108*i* of a hand-held power tool housing.

Figure 11:
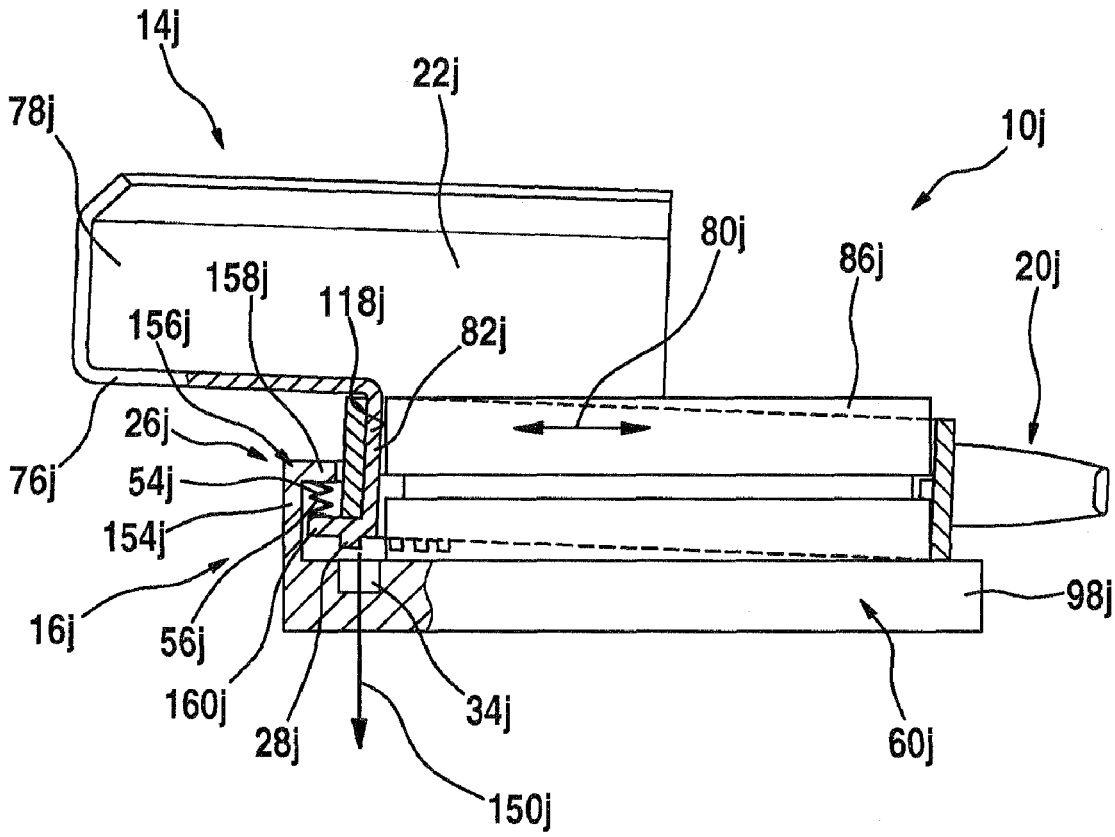
FIG. 11 shows a guard anti-rotation lock unit with anti-rotation lock elements designed as a single piece with a guard, which is held in an anti-rotation lock position using a spring element, in a schematic partial view.

FIG. 11 shows a hand-held power tool system 10*j* with a guard anti-rotation lock unit 16*j*, a receiving unit 60*j*, and a guard unit 14*j*. Guard anti-rotation lock unit 16*j* includes a form-fit unit 26*j*, which is provided to prevent guard 22*j* from rotating on a hand-held power tool at the same time as guard unit 14*j* is being attached to the hand-held power tool. Several anti-rotation lock elements 28*j* are located on a guard collar 82*j* of guard 22*j* of guard unit 14*j*, which extend away from guard collar 82*j* in a direction 150*j* facing away from guard 22*j*. Only one of the anti-rotation lock elements 28*j* is shown. In an alternative embodiment of the present invention, anti-rotation lock elements 28*j* may basically also be located on clamping band 84*j*, instead of on guard collar 82*j*. Anti-rotation lock elements 28*j* are designed as single pieces with guard collar 82*j* and are located one after the other in a circumferential direction on guard collar 82*j*. Receiving unit 60*j* also includes several anti-rotation lock elements 34*j*, which are designed as single pieces with receiving unit 60*j*. Anti-rotation lock elements 34*j* are designed as recesses and are located one after the other in the circumferential direction around a receiving flange 86*j* on a main element 98*j* of receiving unit 60*j*. To prevent the anti-rotation lock position of guard 22*j* from accidentally coming loose from the hand-held power tool, receiving unit 60*j* includes an edge element 154*j* in the region of anti-rotation lock elements 34*j*. Edge element 154*j* is oriented essentially parallel to a surface 118*j* of receiving flange 86*j* that points in radial direction 80*j*, and is designed as a single piece with receiving unit 60*j*. In addition, edge element 154*j* is located at a distance from surface 118*j* on receiving unit 60*j*. Anti-rotation lock elements 34*j* are located between edge element 154*j* and surface 118*j*. On an end 156*j* of edge element 154*j* facing anti-rotation lock elements 34*j*, edge element 154*j* includes a support element 158*j*, which extends inwardly in a radial direction 80*j*. A moving element 54*j*, which is designed as a spring element 56*j* and is located on guard unit 14*j*, bears against support element 158*j* during installation and when guard unit 14*j* is in a working position. To this end, guard unit 14*j* also includes an edge element 160*j*, which extends outwardly from guard collar 82*j* in radial direction 80*j* and is located on an edge region of guard collar 82*j* facing anti-rotation lock elements 34*j*. Spring element 56*j* is located on edge element 160*j*. To remove guard unit 14*j*, it must be lifted, in order to disengage anti-rotation lock elements 28*j*, 34*j*, and so that it may be subsequently rotated, thereby separating the two edge elements 154*j*, 160*j* in the circumferential direction, so that guard unit 14*j* may be removed by an operator.

Figure 12:
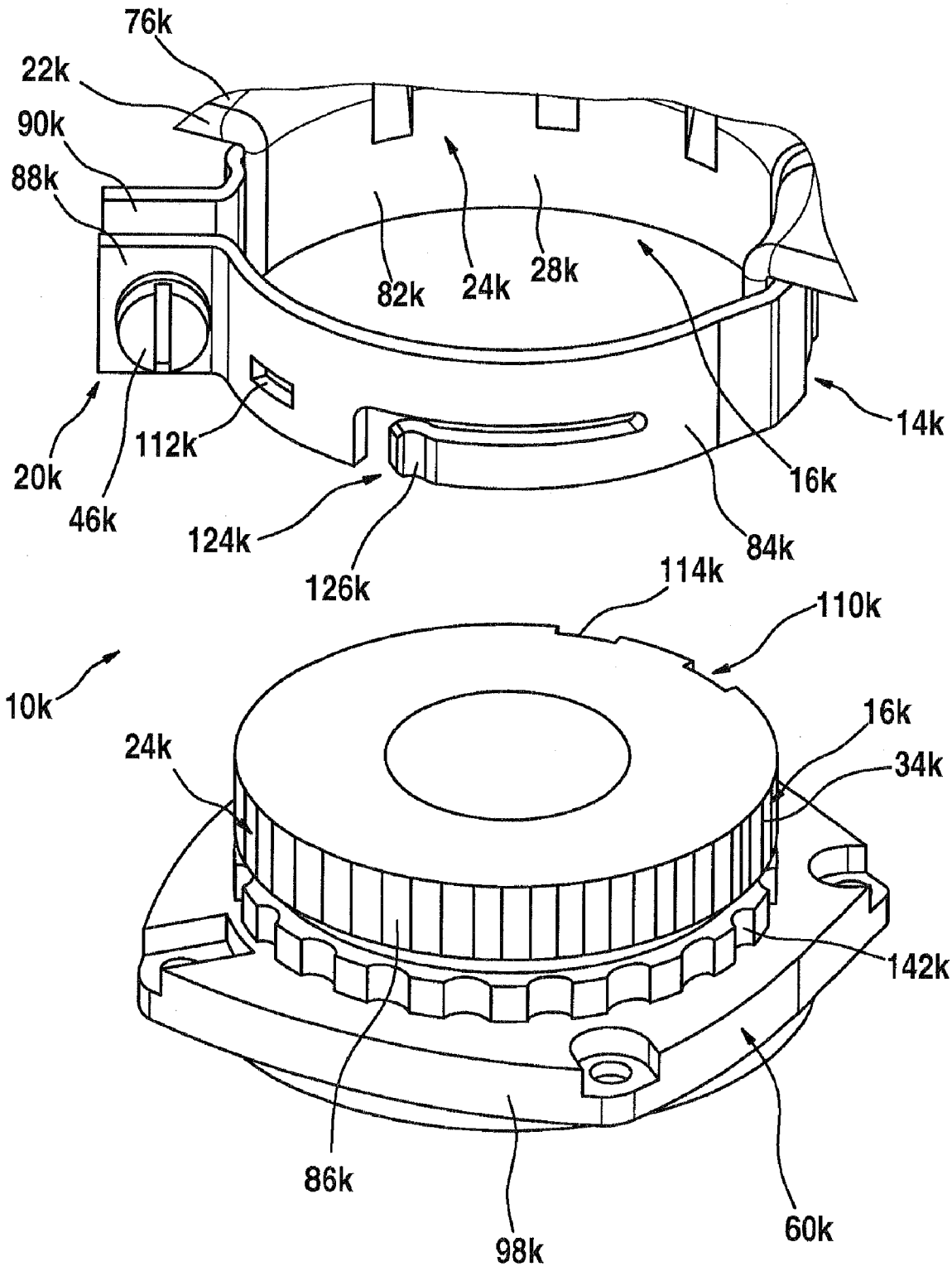
FIG. 12 shows a guard anti-rotation lock unit with an anti-rotation lock that is based on a non-positive connection, in an exploded view.

FIG. 12 shows a hand-held power tool system 10*k* with a guard anti-rotation lock unit 16*k*, a receiving unit 60*k*, and a guard unit 14*k*. Guard anti-rotation lock unit 16*k* includes a non-positive connection unit 24*k*, which is provided to prevent guard 22*k* from rotating on a hand-held power tool at the same time as guard unit 14*k* is being attached to the hand-held power tool. To this end, a receiving unit 60*k* and a guard collar 82*k* each include an anti-rotation lock element 28*k*, 34*k*, each of which is designed as a coated surface with a high friction coefficient. It is also basically feasible for the surfaces of guard collar 82*k* and receiving flange 86*k* to have a desired friction coefficient due to the material selected and/or a surface treatment. When guard unit 14*k* is in an installed state and/or a working position, guard unit 14*k* is attached to receiving unit 60*k* in a non-positive manner via a closing unit 20*k*. When guard unit 14*k* is in an installed state, the coated surfaces bear against each other, so that, if a tool should burst, an anti-rotation lock results due to a frictional connection between the two coated surfaces and/or between guard unit 14*k* and the hand-held power tool.

Figure 13A:
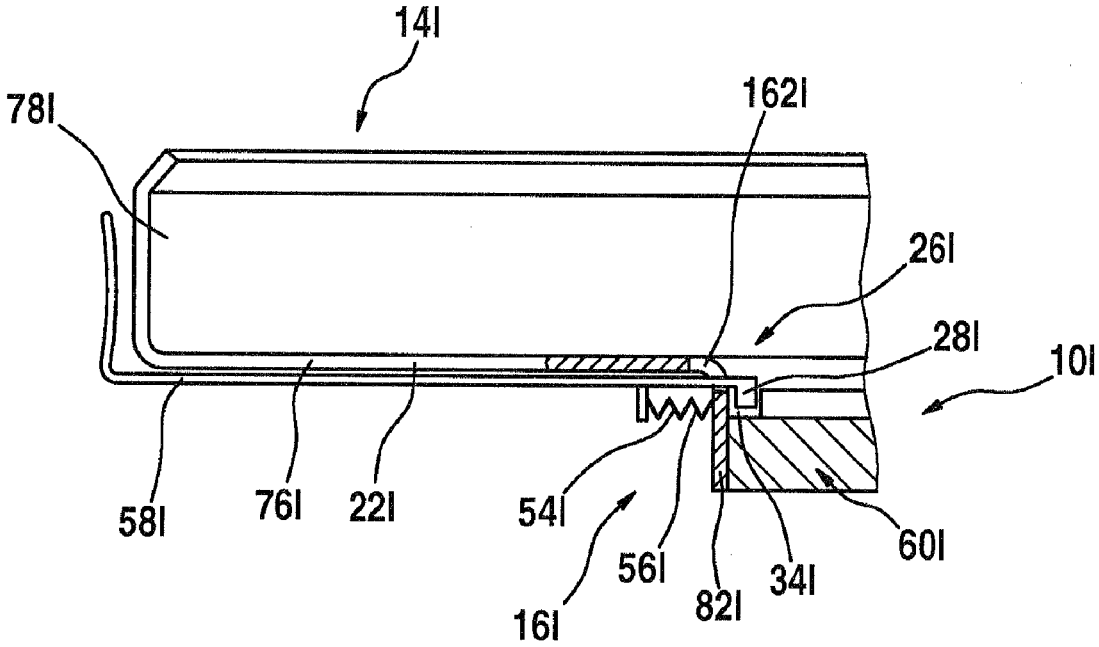
FIGS. 13*a* and 13*b* show a guard anti-rotation lock unit with a release element located on the guard, in a schematic cross-sectional view (FIG. 13*a*), and in a perspective partial view (FIG. 13*b*)
Figure 13B:
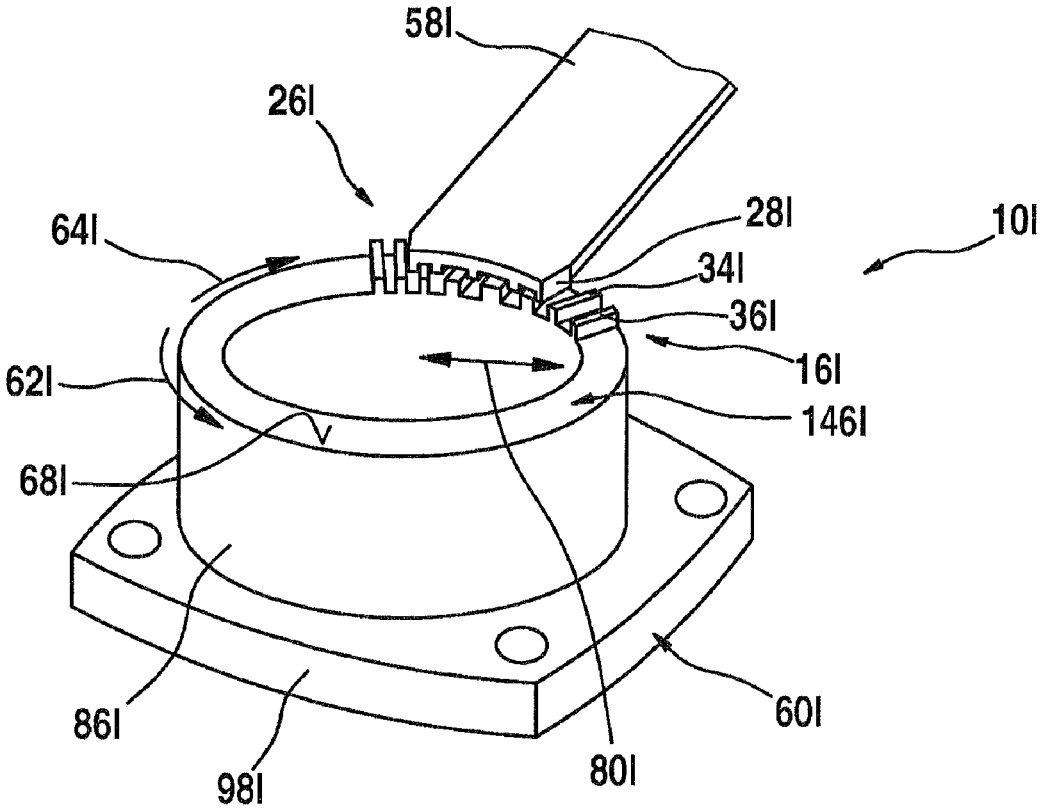

FIGS. 13*a* and 13*b* show a partial cross-sectional view of a hand-held power tool system 10*l* with a guard anti-rotation lock unit 16*l*, a receiving unit 60*l*, and a guard unit 14*l*. Guard anti-rotation lock unit 16*l* includes a form-fit unit 26*l*, which is provided to prevent guard 11*l* from rotating on a hand-held power tool at the same time as guard unit 14*l* is being attached to the hand-held power tool. To this end, receiving unit 60*l* includes several anti-rotation lock elements 34*l*, 36*l* of guard anti-rotation lock unit 16*l*, which are located one after the other in circumferential direction 62*l*, 64*l*, and which form a toothing and extend away from side 68*l* in an outer—in radial direction 80*l*—edge region 146*l*. When hand-held power tool 10*l* is in an installed state, side 68*l* faces a tool. A further anti-rotation lock element 28*l*, which is designed as a toothing that corresponds to anti-rotation lock elements 34*l*, 36*l* of receiving unit 60*l*, is located on guard unit 14*l*. Anti-rotation lock element 28*l* is designed as a single piece with a release element 58*l*, which is supported on guard 22*l* such that it is movable in radial direction 80*l*. Release element 58*l* is integrally formed with an outer contour of guard 22*l*. Release element 58*l* is located such that it is separated from a guard edge 78*l* of guard 22*l* in radial direction 80*l*, thereby making it possible for release element 58*l* to move into an anti-rotation lock position and/or out of the anti-rotation lock position. For engagement in anti-rotation lock elements 34*l*, 36*l* of receiving unit 60*l* , a guard collar 82*l* includes a recess 162*l*, through which release element 58*l* extends, together with anti-rotation lock element 28*l*. To move release element 58*l* together with anti-rotation lock element 28*l* into an anti-rotation lock position at the same time as guard 14*l* reaches a working position, and/or to hold it in the anti-rotation lock position, guard anti-rotation lock unit 16*l* includes a moving element 54*l* designed as a spring element 56*l*, which presses release element 58*l* inwardly in radial direction 80*l* against a guard collar 82*l*. An anti-rotation lock position of anti-rotation lock element 28*l* with anti-rotation lock elements 34*l*, 36*l* of receiving unit 60*l* is reached when release element 58*l* is located in an outer—in radial direction 80*l*—end position. To release the anti-rotation lock, an operator presses release element 58*l* inwardly against a spring force of spring element 56*l*, and anti-rotation lock element 28*l* of guard unit 14*l* is slid out of engagement with anti-rotation lock elements 34*l*, 36*l* of receiving unit 60*l*. The position of guard unit 14*l* on the hand-held power tool may therefore be changed.

Figure 14:
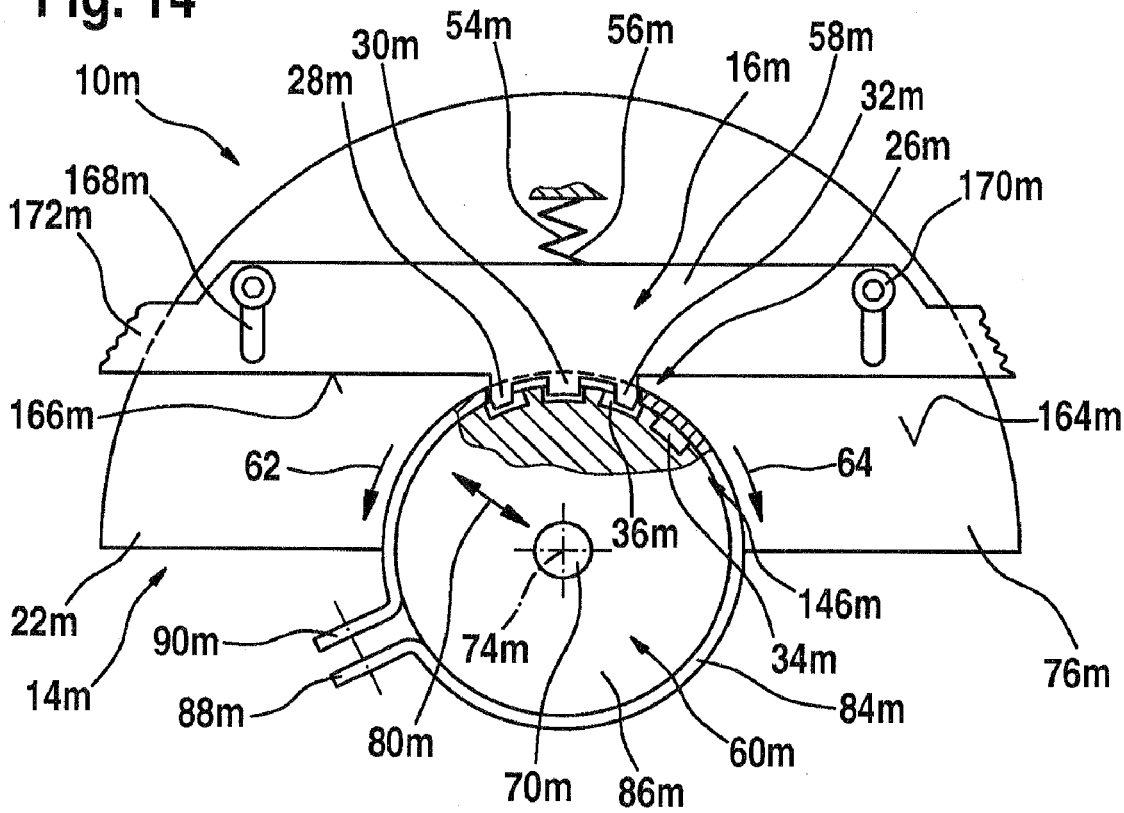
FIG. 14 shows a guard anti-rotation lock unit with an anti-rotation lock element and a release element located on the guard, in a schematic top view.

FIG. 14 shows a hand-held power tool system 10*m* with a guard anti-rotation lock unit 16*m*, a receiving unit 60*m*, and a guard unit 14*m*, in a partial cross-section. Guard anti-rotation lock unit 16*m* includes a form-fit unit 26*m*, which is provided to prevent guard 22*m* from rotating on a hand-held power tool at the same time as guard unit 14*m* is being attached to the hand-held power tool. To this end, a receiving unit 60*m* includes several anti-rotation lock elements 34*m*, 36*m* of guard anti-rotation lock unit 16*m*, which are located one after the other in circumferential direction 62*m*, 64*m*, and which are formed by recesses and are located in an outer—in radial direction 80*m*—edge region 146*m*. Guard anti-rotation lock unit 16*m* also includes further anti-rotation lock elements 28*m*, 30*m*, 32*m*, which are designed as single pieces with a release element 58*m*, which is located on a side 164*m* of a guard body 76*m* of a guard 22*m* that faces away from a tool. When guard unit 14*m* is in a working position, release element 58*m* is located tangentially to receiving unit 60*m* on guard 22*m*. Anti-rotation lock elements 28*m*, 30*m*, 32*m* extend—on a side 166*m* of release element 58*m* facing receiving unit 60*m*—inwardly in radial direction 80*m*. Release element 58*m* includes two recesses 168*m*, which are designed as slots, by way of which release element 58*m* is supported on guard 22*m* such that it may move inwardly or outwardly. To this end, screws 170*m*—which are screwed together with guard 22*m*—are supported in recesses 168*m*. To move or hold release element 58*m* in an anti-rotation lock position, guard anti-rotation lock unit 16*m* includes a moving element 54*m*, which is designed as a spring element 56*m* and bears against guard 22*m*. Release element 58*m* extends with both end regions 172*m* beyond guard body 76*m*, thereby making it possible for an operator to easily move release element 58*m* out of its anti-rotation lock position. The operator may actuate it on either end region 172*m*. A design of anti-rotation lock elements 28*m*, 30*m*, 32*m* of guard unit 14*m* and the recesses of receiving unit 60*m* also makes it possible for guard unit 14*m* to be easily inserted onto the hand-held power tool in that, when one of the anti-rotation lock elements 28*m*, 30*m*, 32*m* of guard unit 14*m* engages, guard 22*m* is centered in the working position with the aid of spring element 56*m*.

Figure 15:
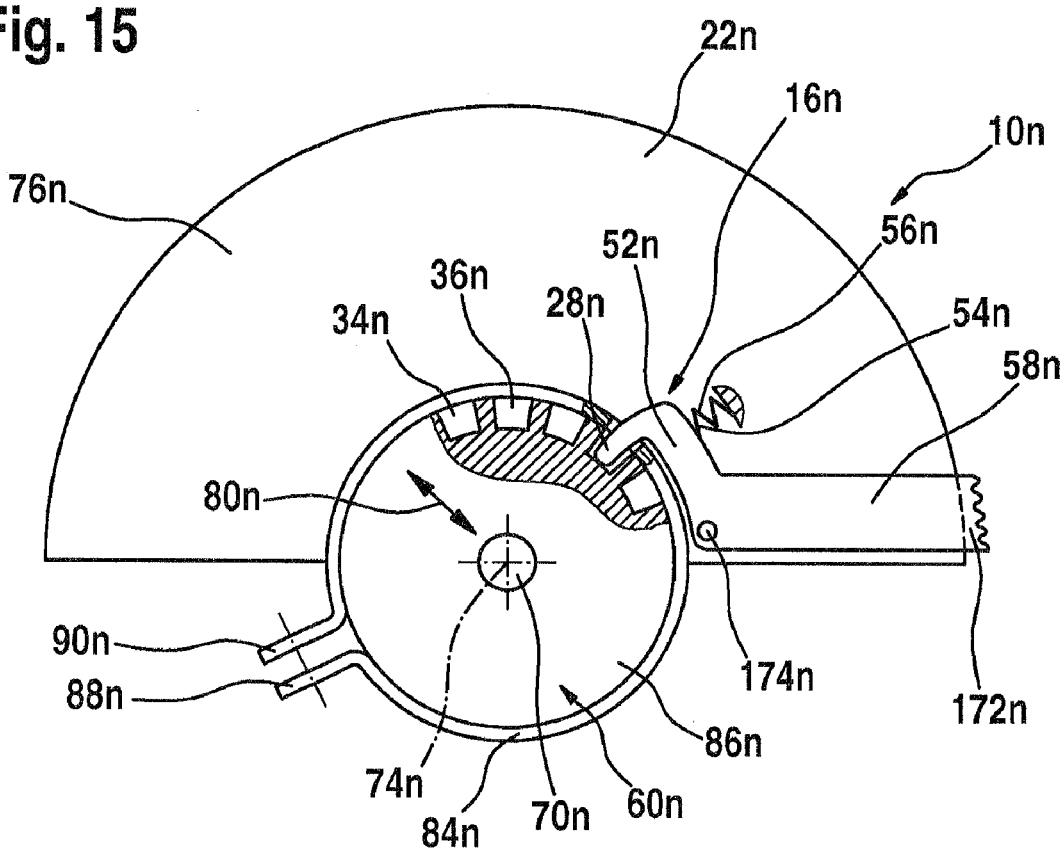
FIG. 15 shows a guard anti-rotation lock unit—that is an alternative to that shown in FIG. 14—with an anti-rotation lock element and a release element located on the guard, in a schematic top view.

FIG. 15 shows a hand-held power tool system 10*n* that is an alternative to that shown in FIG. 14. Hand-held power tool system 10*n* differs from that shown in FIG. 14 in that a release element 58*n* of a guard anti-rotation lock unit 16*n* is designed as a single piece with an anti-rotation lock element 28*n* and is rotatably supported via a pivot bearing 174*n* on a guard body 76*n* of a guard 22*n*. A rotation axis of release element 58*n* is oriented essentially perpendicularly to a guard body 76*m*. Release element 58*n* is held—together with anti-rotation lock element 28*m*—in an anti-rotation lock position with release unit 60*m* via a moving element 54*m*, which is designed as a spring element 56*m*.

What is claimed is:

1. A hand-held power tool system, comprising a hand-held power tool; a guard unit; and a guard anti-rotation lock unit preventing rotation of said guard unit relative to said hand-held power tool during breakdown of a tool, said guard anti-rotation lock unit being configured to prevent rotation of said guard unit relative to said hand-held power tool around an axis at a same time as said guard unit is being attached to said hand-held power tool when said guard unit is in a working position, said guard unit including a closing unit with a clamping band, said guard anti-rotation lock unit including an anti-rotation lock element consisting of a single end region of said clamping band, which single end region is bent inwardly toward the axis relative to a remaining region of said clamping band, which remaining region of said clamping band is circular around the axis with the exception of said single bent end region of said clamping band, and a plurality of detent recesses provided on a periphery of a receiving unit for accommodating a tool of said hand-held power tool and spaced from one another in a circumferential direction, wherein said single bent end region of said clamping band is engageable in a respective one of said detent recesses of said receiving unit and thereby prevents rotation of said guard unit relative to said hand-held power tool.

* * * * *